US010571857B2

(12) United States Patent
Nonaka et al.

(10) Patent No.: US 10,571,857 B2
(45) Date of Patent: Feb. 25, 2020

(54) ROTATABLE MEMBER, PROCESS CARTRIDGE AND IMAGE FORMING APPARATUS

(71) Applicant: CANON KABUSHIKI KAISHA, Tokyo (JP)

(72) Inventors: Fumito Nonaka, Mishima (JP); Hiroomi Matsuzaki, Mishima (JP); Koji Yamaguchi, Numazu (JP); Makoto Hayashida, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/947,109

(22) Filed: Apr. 6, 2018

(65) Prior Publication Data

US 2018/0299826 A1 Oct. 18, 2018

(30) Foreign Application Priority Data

Apr. 17, 2017 (JP) ..... 2017-081257
Feb. 22, 2018 (JP) ..... 2018-029515

(51) Int. Cl.
*G03G 21/18* (2006.01)
*G03G 21/16* (2006.01)
(Continued)

(52) U.S. Cl.
CPC ..... *G03G 21/1857* (2013.01); *G03G 21/1647* (2013.01); *G03G 21/181* (2013.01);
(Continued)

(58) Field of Classification Search
CPC ..... G03G 21/1857
(Continued)

(56) References Cited

U.S. PATENT DOCUMENTS 7,162,181 B2 1/2007 Maeshima et al.
9,360,788 B2 6/2016 Kamata et al.
(Continued)

FOREIGN PATENT DOCUMENTS

JP 2005-164756 A 6/2005
JP 2017-068018 A 4/2017
(Continued)

OTHER PUBLICATIONS

Copending, unpublished, U.S. Appl. No. 15/935,440 to Koji Yamaguchi, et al., filed Mar. 26, 2018.
(Continued)

*Primary Examiner* — Walter L Lindsay, Jr.
*Assistant Examiner* — Philipmarcus T Fadul
(74) *Attorney, Agent, or Firm* — Venable LLP

(57) ABSTRACT

A rotatable member includes a hollow cylindrical rotation shaft formed with a curved plate-like member. The rotation shaft includes a seam where end surfaces of the plate-like member are contacted to each other. The rotation shaft includes a rotational drive transmitting portion which is provided at an axial end portion thereof and which includes a contact surface contactable to a driver for driving the rotation shaft and configured to receive the driving force from the driver. In a coordinate system with the rotational axis as an origin, the contact surface is provided at a position away by 90° or more from the seam in a normal rotational direction which is a direction in which the rotatable member rotates to form an image.

19 Claims, 21 Drawing Sheets

(51) Int. Cl.

| | |
|---|---|
| *G03G 15/08* | (2006.01) |
| *G03G 15/00* | (2006.01) |
| *G03G 15/02* | (2006.01) |

(52) U.S. Cl.
CPC ..... *G03G 15/0233* (2013.01); *G03G 15/0818* (2013.01); *G03G 15/6552* (2013.01); *G03G 2221/1657* (2013.01); *G03G 2221/1861* (2013.01)

(58) Field of Classification Search
USPC ..... 399/111
See application file for complete search history.

(56) References Cited

U.S. PATENT DOCUMENTS

| | | | | |
|---|---|---|---|---|
| 9,423,715 | B2 | 8/2016 | Kamata et al. | |
| 9,500,977 | B2 | 11/2016 | Matsuzaki et al. | |
| 2017/0371263 | A1 | 12/2017 | Hayashida et al. | |
| 2017/0371264 | A1 | 12/2017 | Nonaka et al. | |
| 2018/0292766 | A1* | 10/2018 | Yamaguchi ..... | G03G 15/0233 |

FOREIGN PATENT DOCUMENTS

| | | | |
|---|---|---|---|
| JP | 2017-146474 | A | 8/2017 |
| JP | 2017-194552 | A | 10/2017 |
| WO | 2017/142099 | A1 | 8/2017 |

OTHER PUBLICATIONS

U.S. Appl. No. 15/783,075, filed Oct. 13, 2017 (First Named Inventor: Fuyuko Koyama).

* cited by examiner (a)

(b)

(a)

(b)

(a)

(b)

(a)

(b)

(a)

(b)

(a)

(b)

ROTATABLE MEMBER, PROCESS CARTRIDGE AND IMAGE FORMING APPARATUS

FIELD OF THE INVENTION AND RELATED ART

The present invention relates to a rotatable member usable for forming an image on a recording material. The present invention also relates to a process cartridge which forms a developer image on an image bearing member such as a photosensitive drum and which is detachably mountable to an apparatus main assembly of an image forming apparatus and relates to the image forming apparatus for forming an image on a recording material with a developer.

Conventionally, in an electrophotographic image forming apparatus, a process cartridge type in which an electrophotographic photosensitive member and a process means actable on the electrophotographic photosensitive member are integrally assembled into a cartridge which is made detachably mountable to an apparatus main assembly of the image forming apparatus is employed.

The electrophotographic image forming apparatus forms an image on a recording medium (material) with use of an electrophotographic image forming process. As examples of the electrophotographic image forming apparatus, an electrophotographic copying machine, an electrophotographic printer (e.g., a laser beam printer, an LED printer, etc.), an electrophotographic facsimile machine, an electrophotographic word processor and the like are included.

The process cartridge is prepared by assembling a developing device and a charging means or a cleaning means, and the electrophotographic photosensitive member into a cartridge (unit) and the cartridge is made detachably mountable to the apparatus main assembly of the image forming apparatus. Further, the developing device is prepared by integrally connecting and assembling a developer accommodating portion accommodating a developer (toner) and a developing means including a developing member into a unit.

According to this process cartridge type, maintenance of the image forming apparatus can be carried out by a user himself (herself) without relying on a service person, so that operativity was able to be remarkably improved. For such a reason, this process cartridge type has been widely used in the image forming apparatus.

The process cartridge includes a photosensitive drum, a charging roller, a cleaning blade, and a cleaning (means) frame for integrally supporting these members. The developing device includes a developing (means) frame for integrally supporting a developing roller, a supplying roller, a developing blade and a toner accommodating portion. Japanese Laid-Open Patent Application 2005-164756 discloses a constitution in which the developing roller, the supplying roller and the charging roller are formed with a round metal rod (shaft) provided with a cylindrical electroconductive rubber or sponge.

In general, the metal shaft is a solid member and includes an engaging portion, such as a gear, engaging with a drive transmitting member in order to transmit rotational drive to the above-described rollers. The engaging portion has been subjected to cutting (machining).

SUMMARY OF THE INVENTION

A principal object of the present invention is to provide a rotatable member capable of suppressing deformation of a rotation shaft due to a change in rotational driving force in the case where a hollow rotation shaft including a seam is used as a shaft portion of the rotatable member, such as a developing roller, a supplying roller or a charging roller, used for forming an image on a recording material.

According to an aspect of the present invention, there is provided a rotatable member usable for forming an image on a recording material, comprising: a hollow cylindrical rotation shaft formed with a curved plate-like member and including an outer peripheral surface and an inner peripheral surface which are cylindrical surfaces, wherein the rotation shaft includes a seam where end surfaces of the plate-like member are contacted to each other from one end to the other end of the rotation shaft with respect to an axial direction of the rotation shaft, wherein the rotation shaft includes a rotational drive transmitting portion which is provided at an axial end portion thereof and to which a driving force for rotating the rotation shaft is transmitted, wherein the rotational drive transmitting portion includes, at an end surface different from the outer peripheral surface and the inner peripheral surface, a contact surface contactable to a driver for driving the rotation shaft and configured to receive the driving force from the driver, and wherein in a coordinate system with the rotational axis as an origin, the contact surface is provided at a position away by 90° or more from the seam in a normal rotational direction which is a direction in which the rotatable member rotates to form the image.

Further features of the present invention will become apparent from the following description of exemplary embodiments with reference to the attached drawings.

BRIEF DESCRIPTION OF THE DRAWINGS

Parts (a) and (b) of FIG. 1 are perspective views showing a structure of a developing roller according to Embodiment 1.

Figure 7:
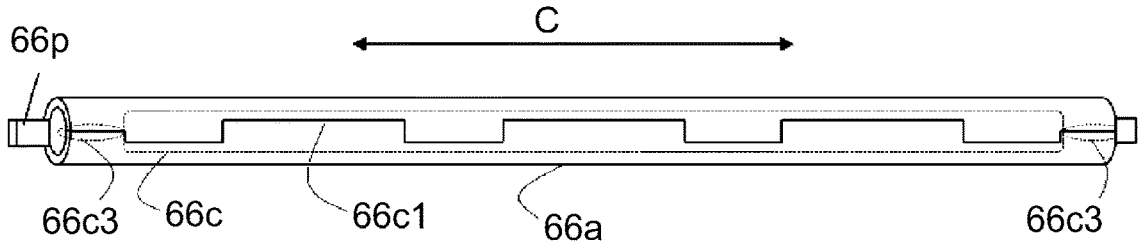
Figure 7:
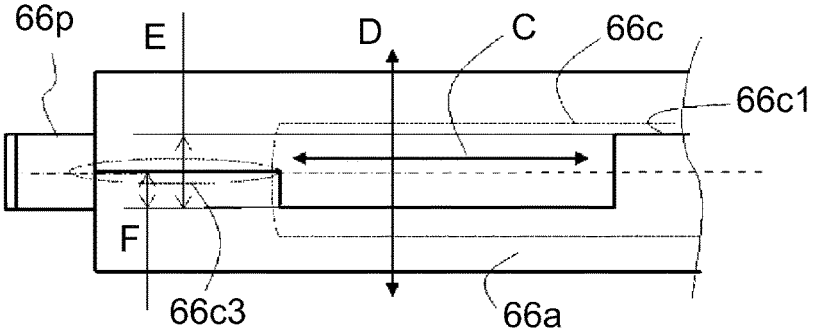

Parts (a) and (b) of FIG. 7 are schematic views for illustrating the shaft portion.

Figure 8:
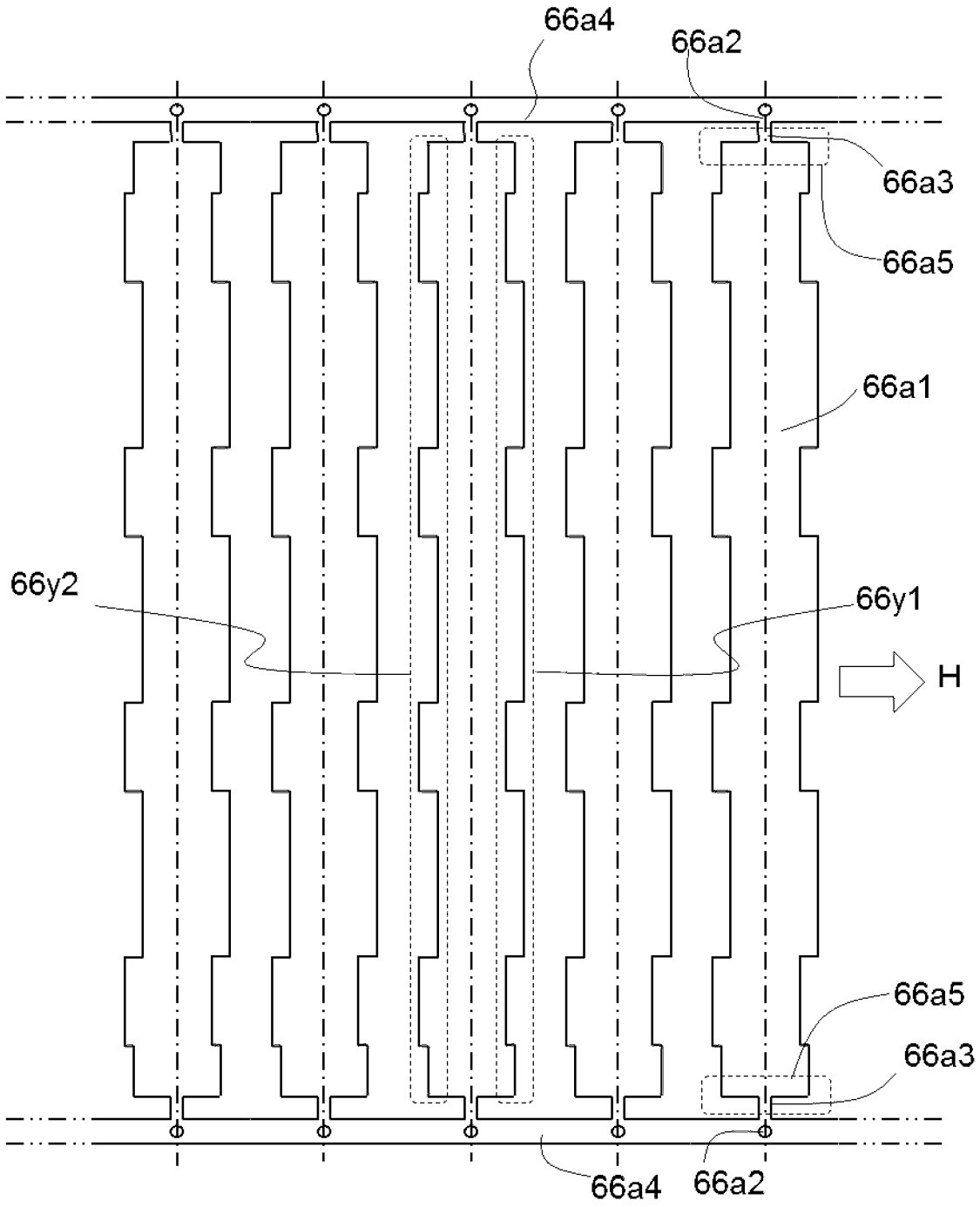

FIG. 8 is a schematic view for illustrating the manufacturing steps of the shaft portion.

Figure 9:
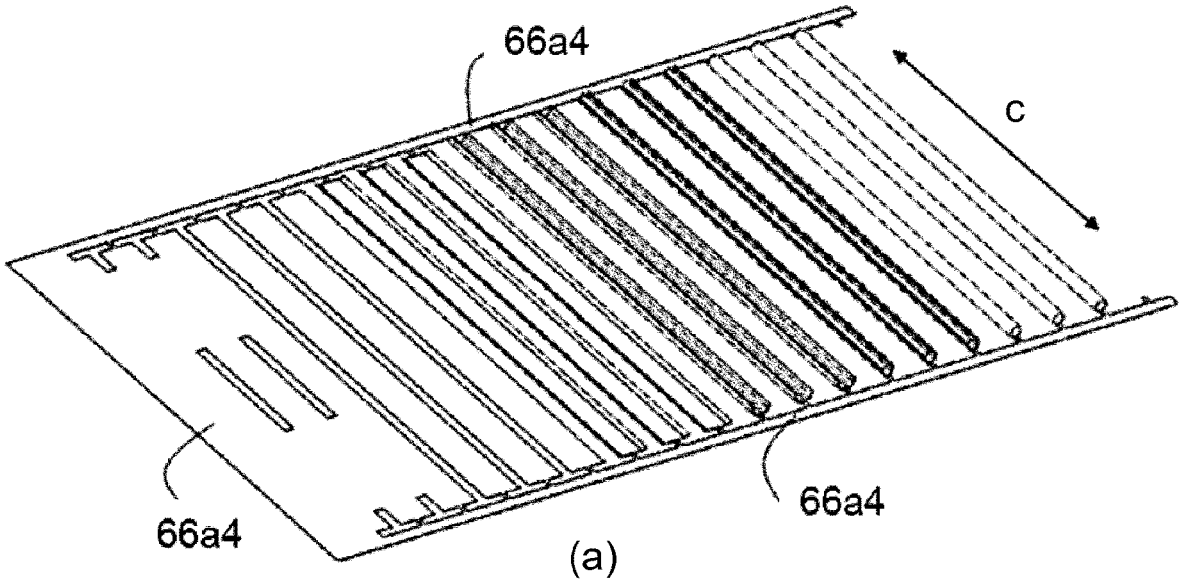
Figure 9:
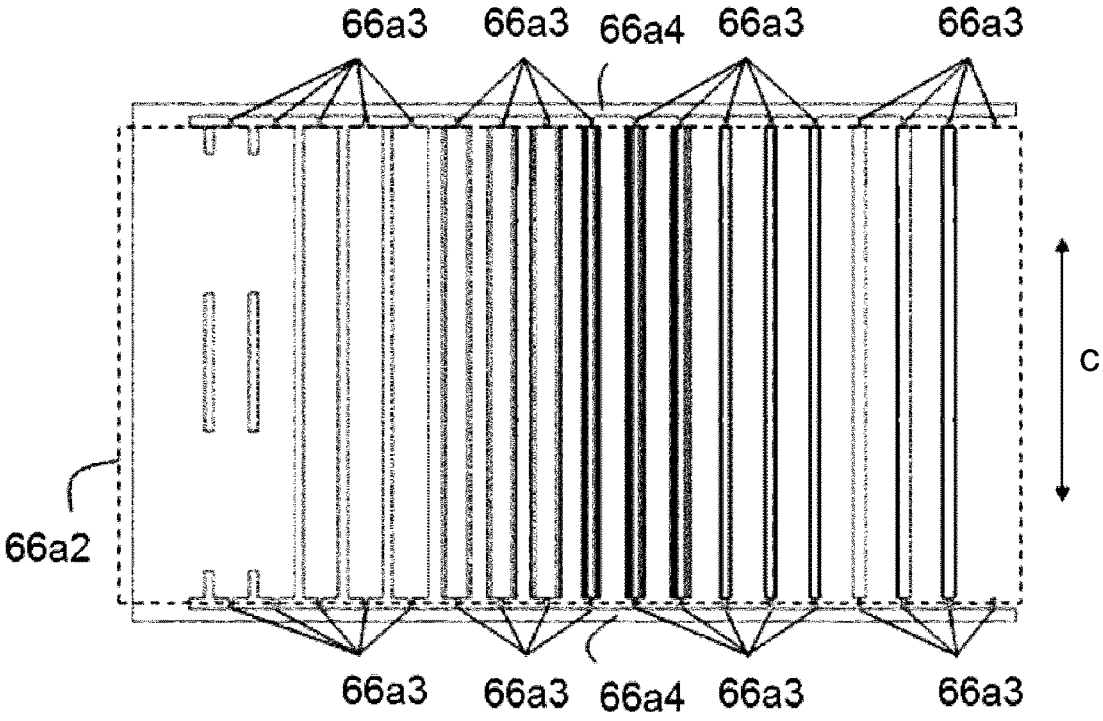

Parts (a) and (b) of FIG. 9 are schematic views for illustrating the manufacturing steps of the shaft portion.

Figure 10:
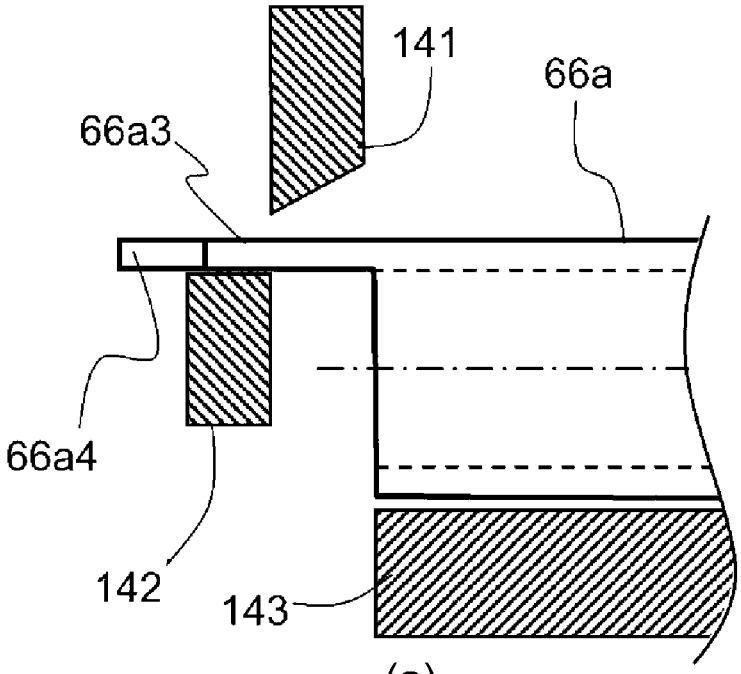
Figure 10:
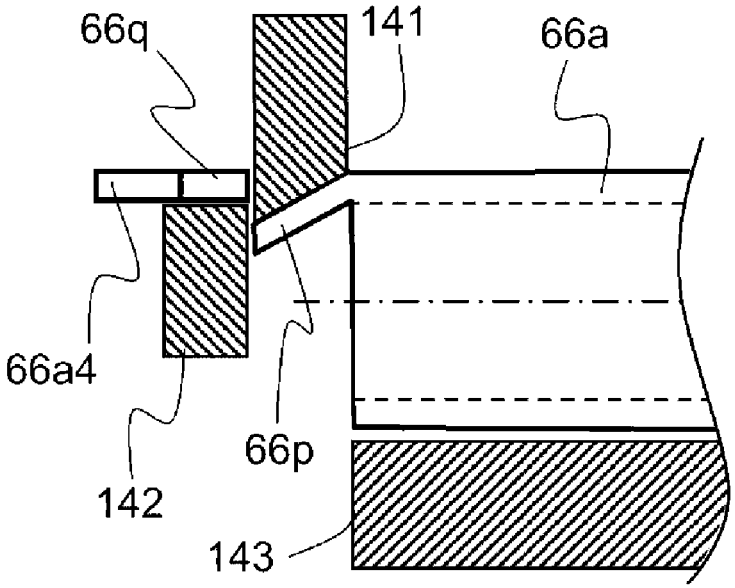

Parts (a) and (b) of FIG. 10 are schematic views for illustrating the manufacturing steps of the shaft portion.

Figure 11:
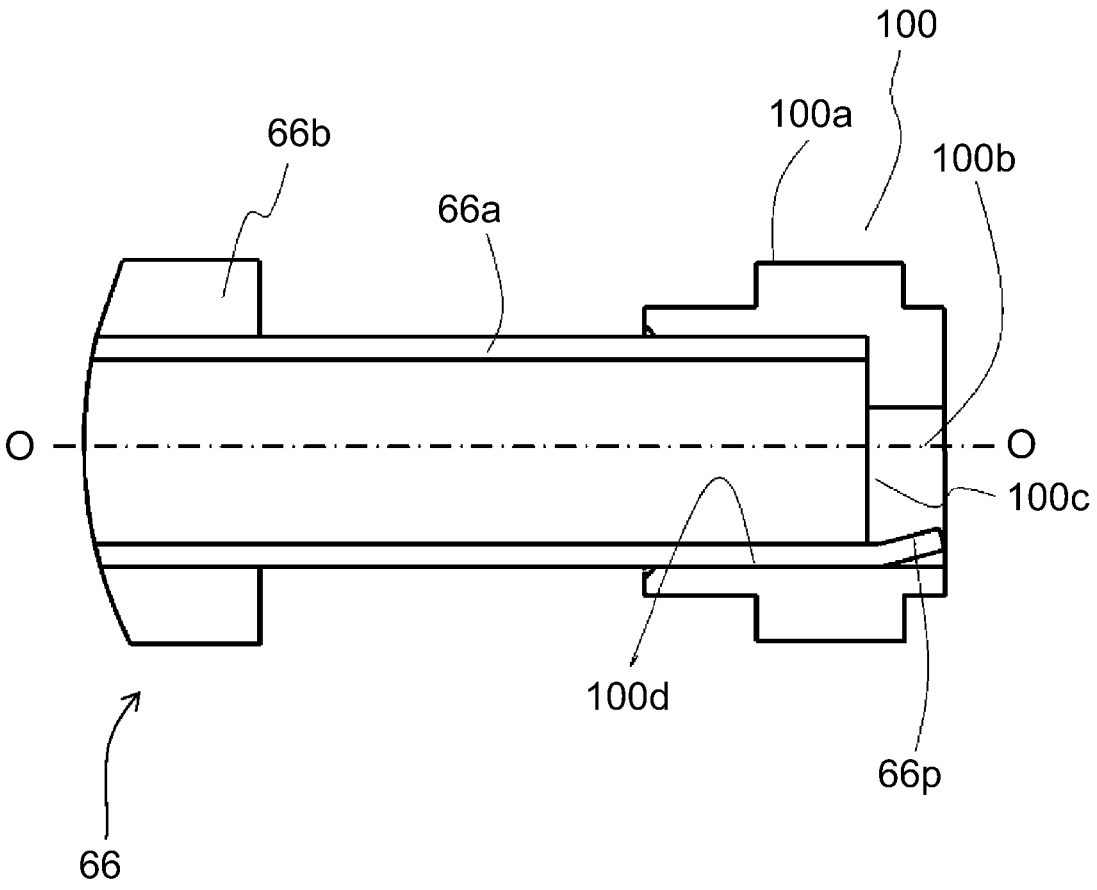

FIG. 11 is a schematic view showing a structure of a driving portion of the developing roller.

Figure 12:
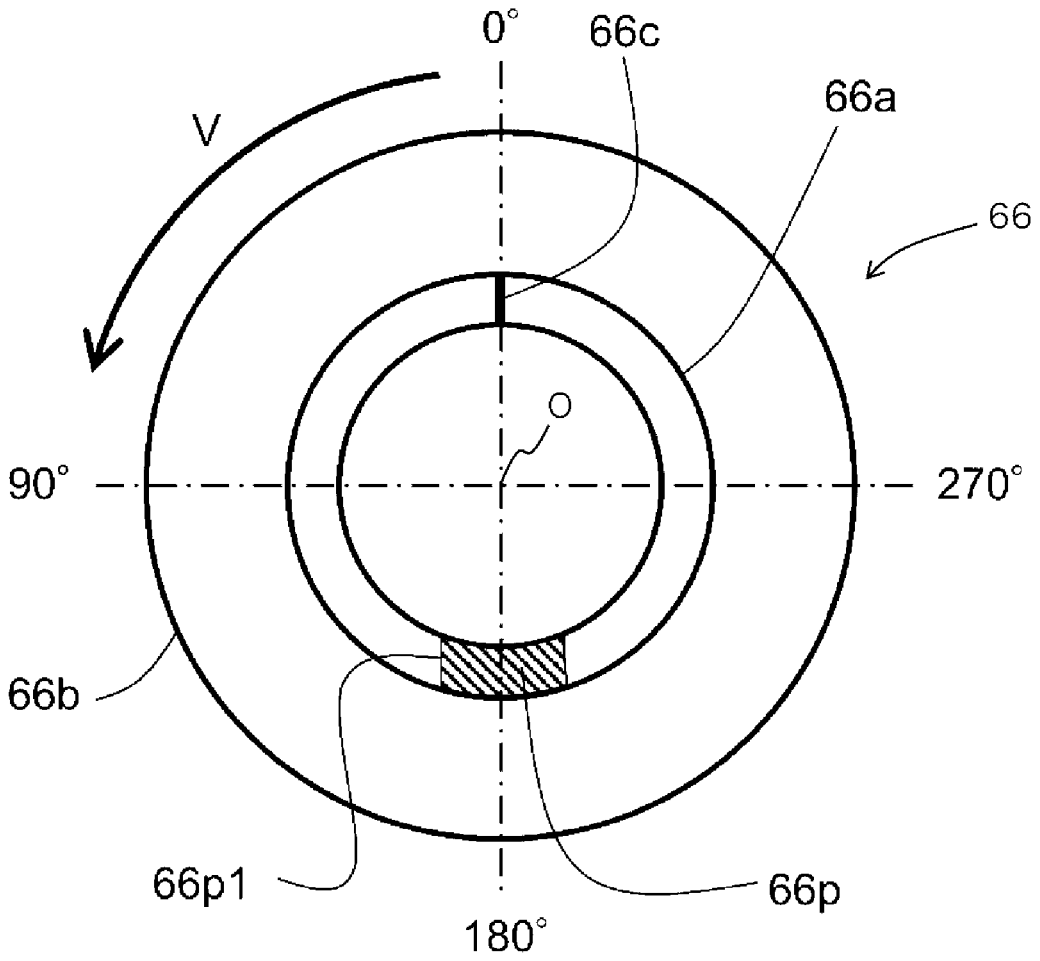

FIG. 12 is a schematic view showing the structure of the driving portion of the developing roller.

Figure 13:
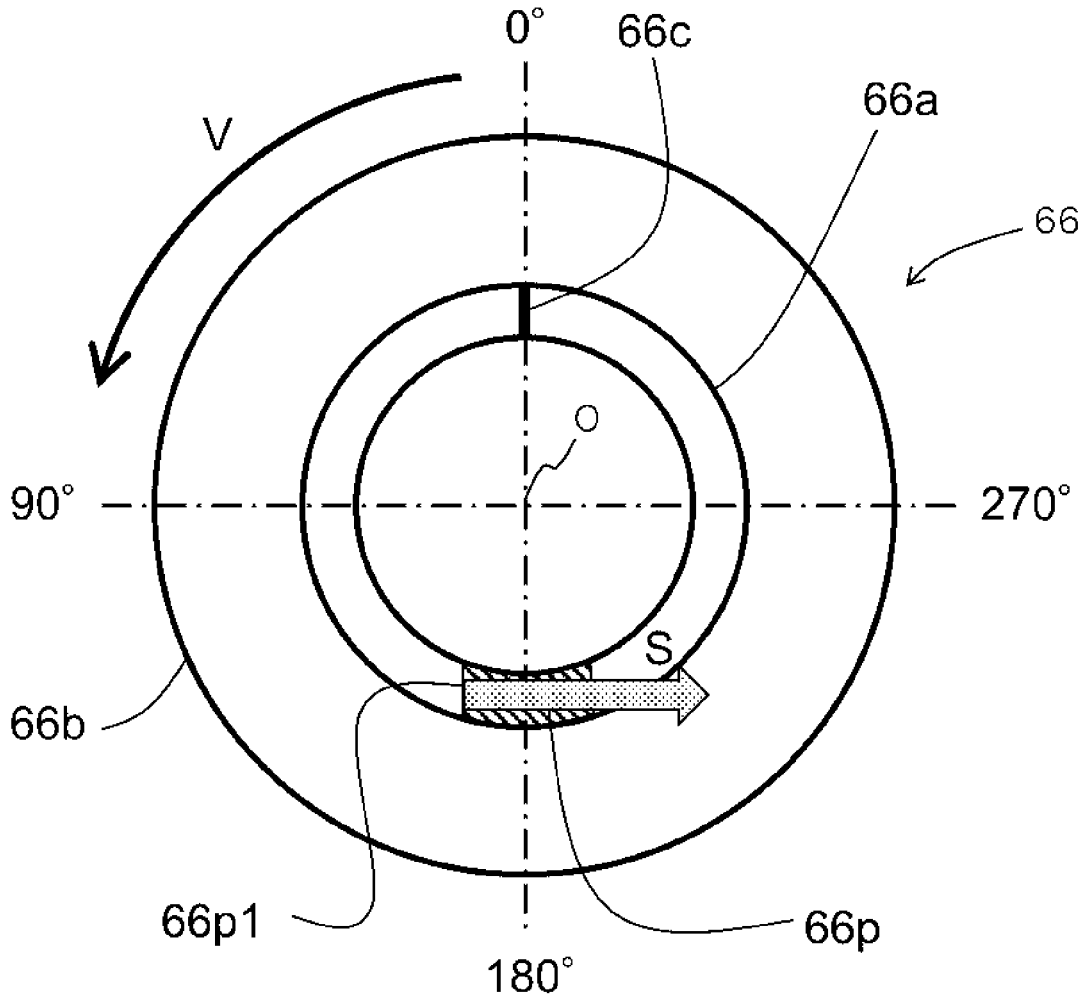

FIG. 13 is a schematic view showing the structure of the driving portion of the developing roller.

Figure 14:
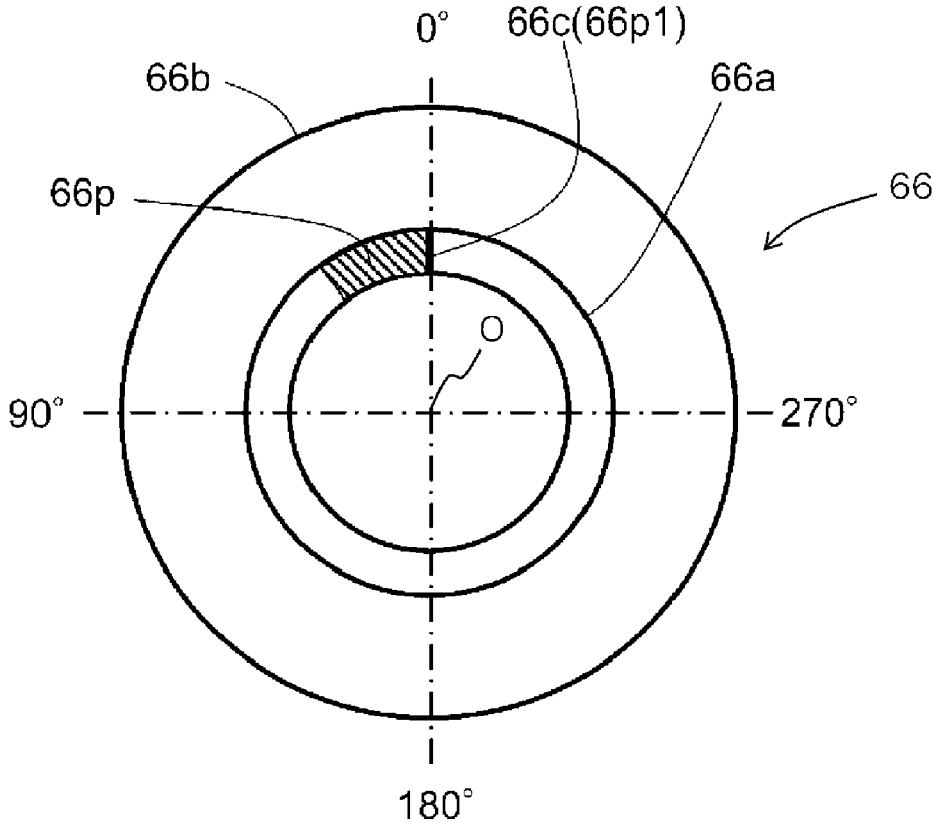
Figure 14:
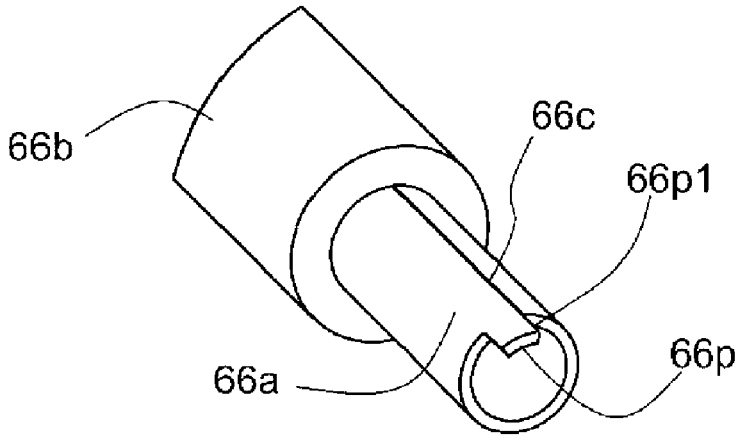

Parts (a) and (b) of FIG. 14 are schematic views showing the structure of the driving portion of the developing roller.

Figure 15:
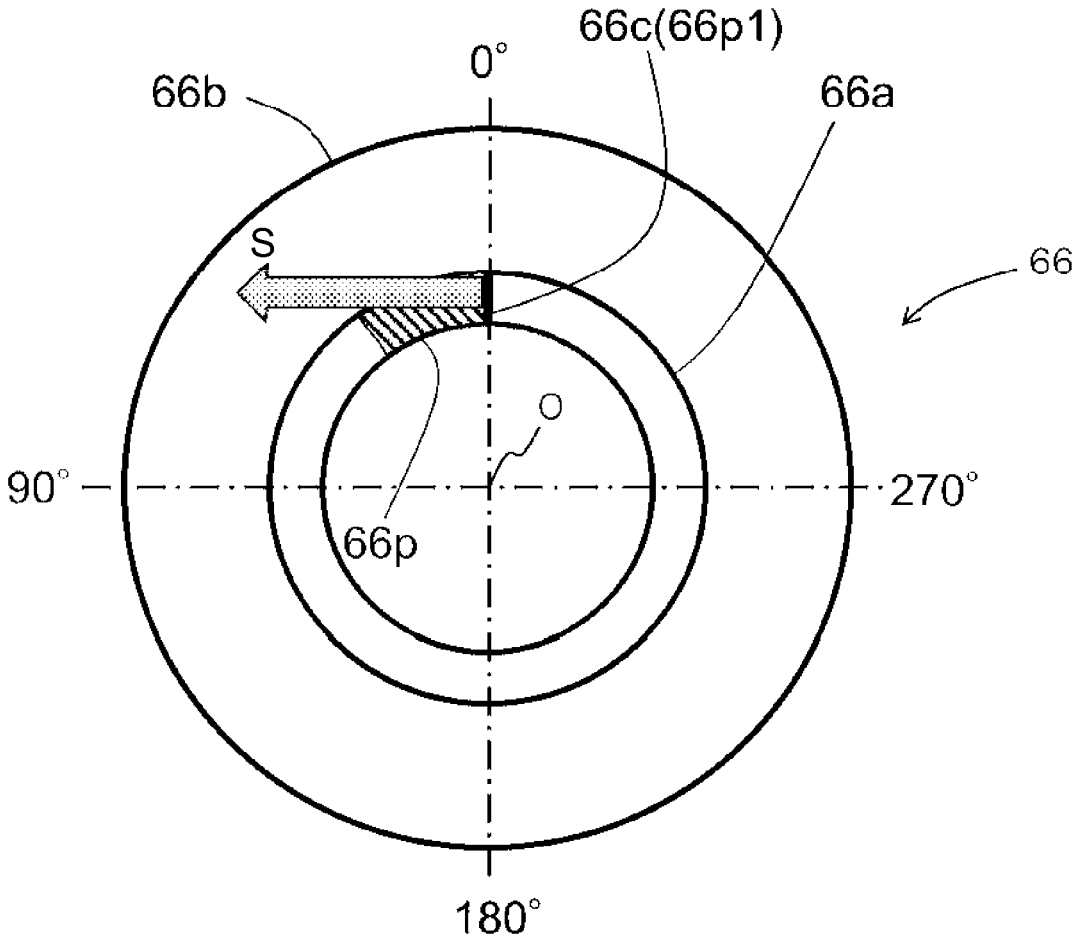

FIG. 15 is a schematic view showing the structure of the driving portion of the developing roller.

Figure 16:
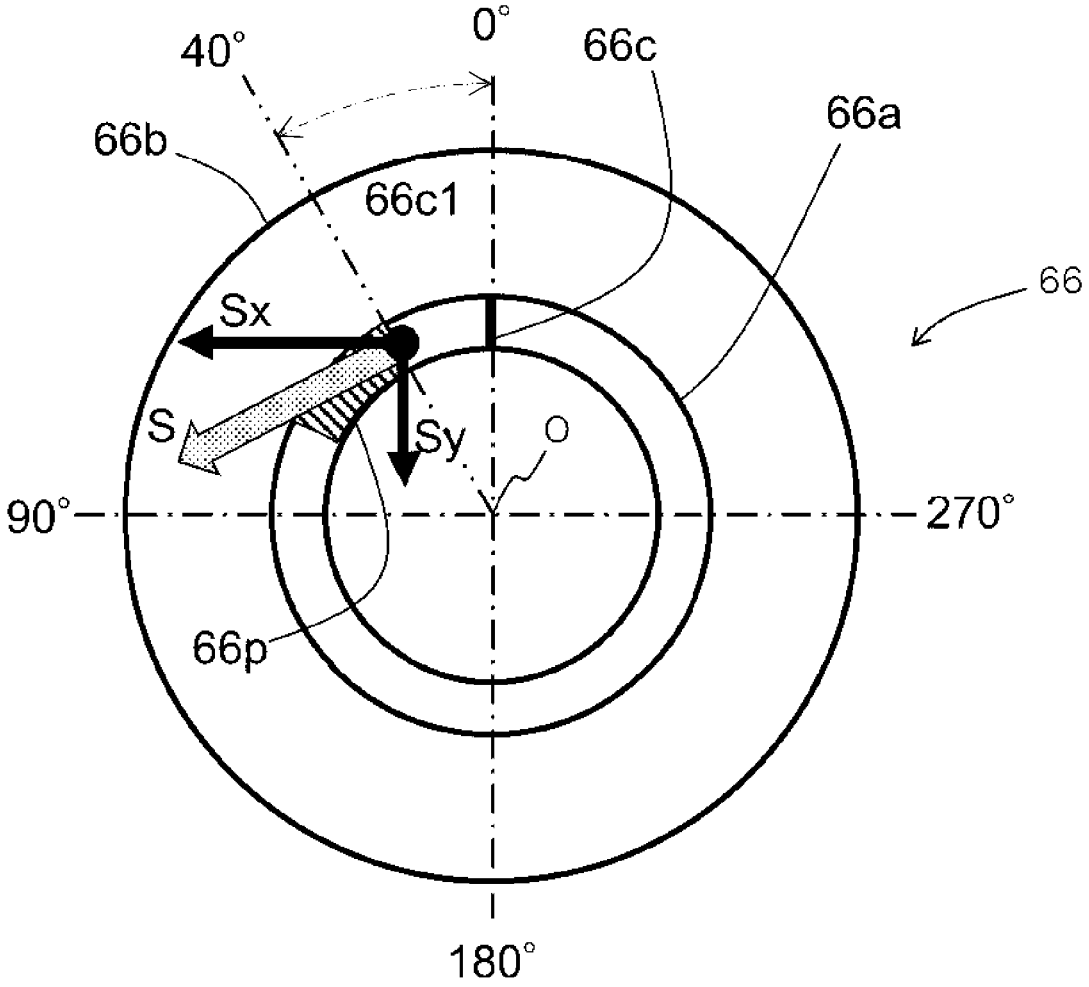

FIG. 16 is a schematic view showing the structure of the driving portion of the developing roller.

Figure 17:
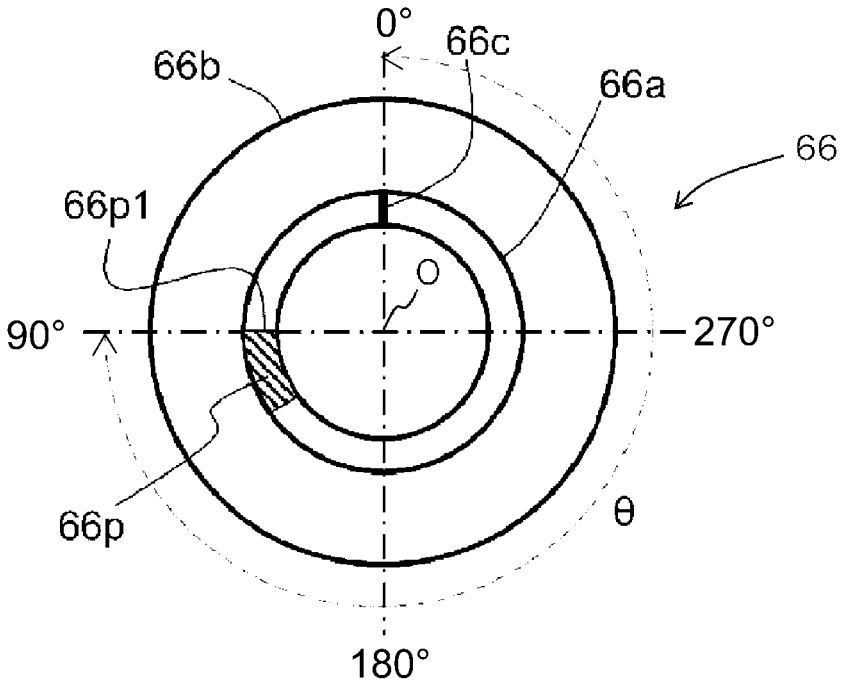
Figure 17:
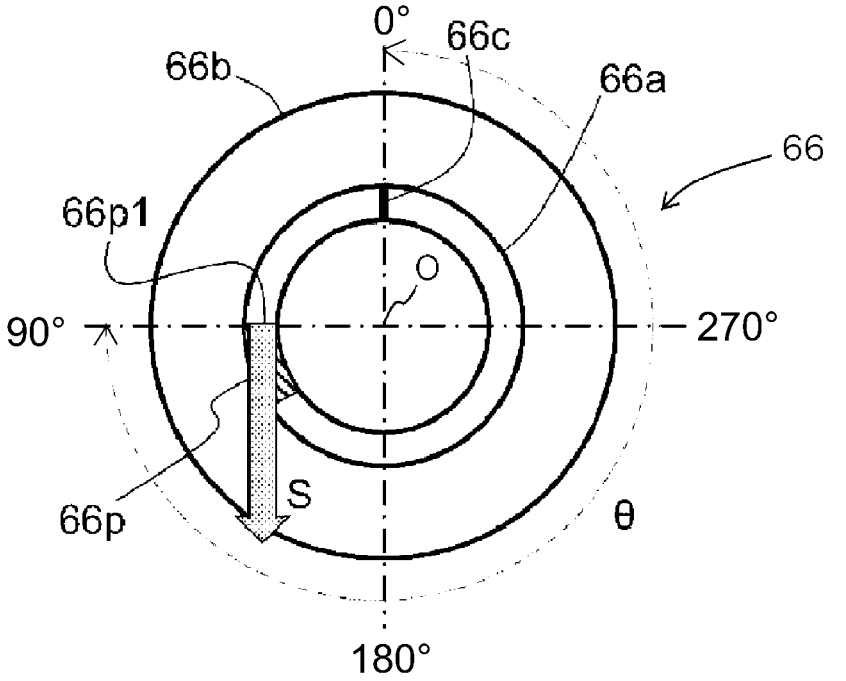

Parts (a) and (b) of FIG. 17 are schematic views showing the structure of the driving portion of the developing roller.

Figure 18:
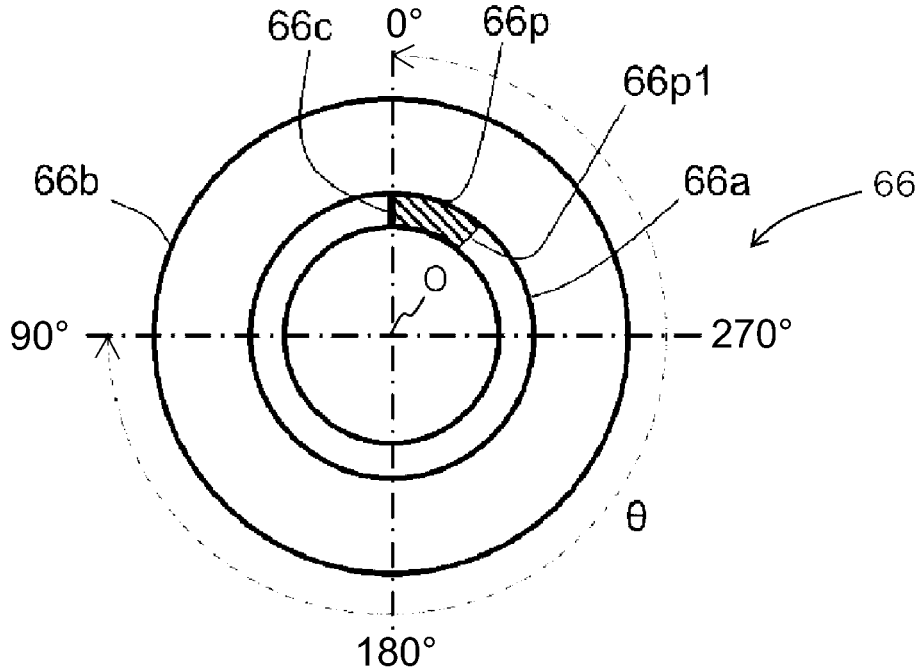
Figure 18:
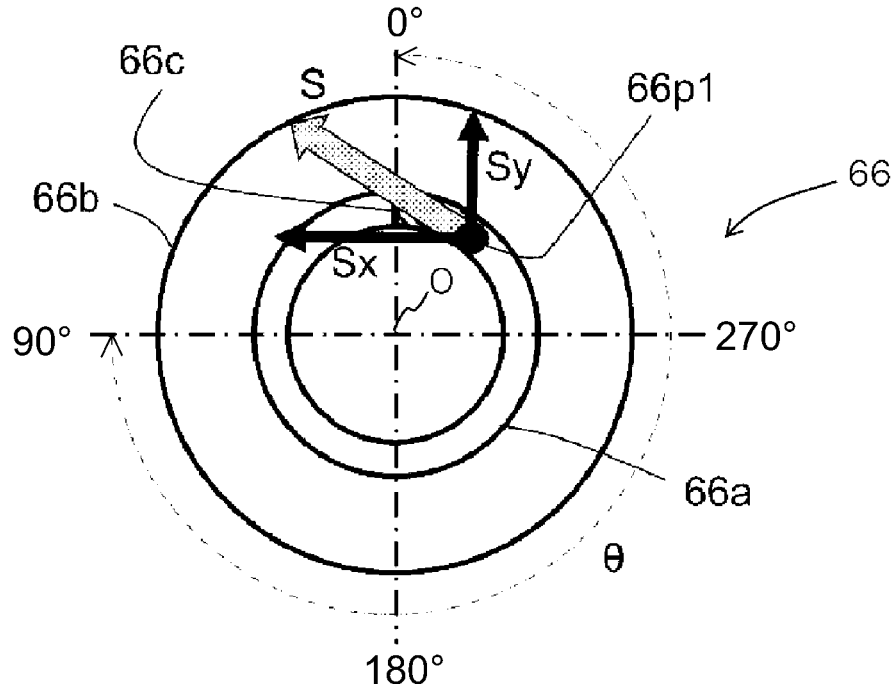

Parts (a) and (b) of FIG. 18 are schematic views showing the structure of the driving portion of the developing roller.

Figure 19:
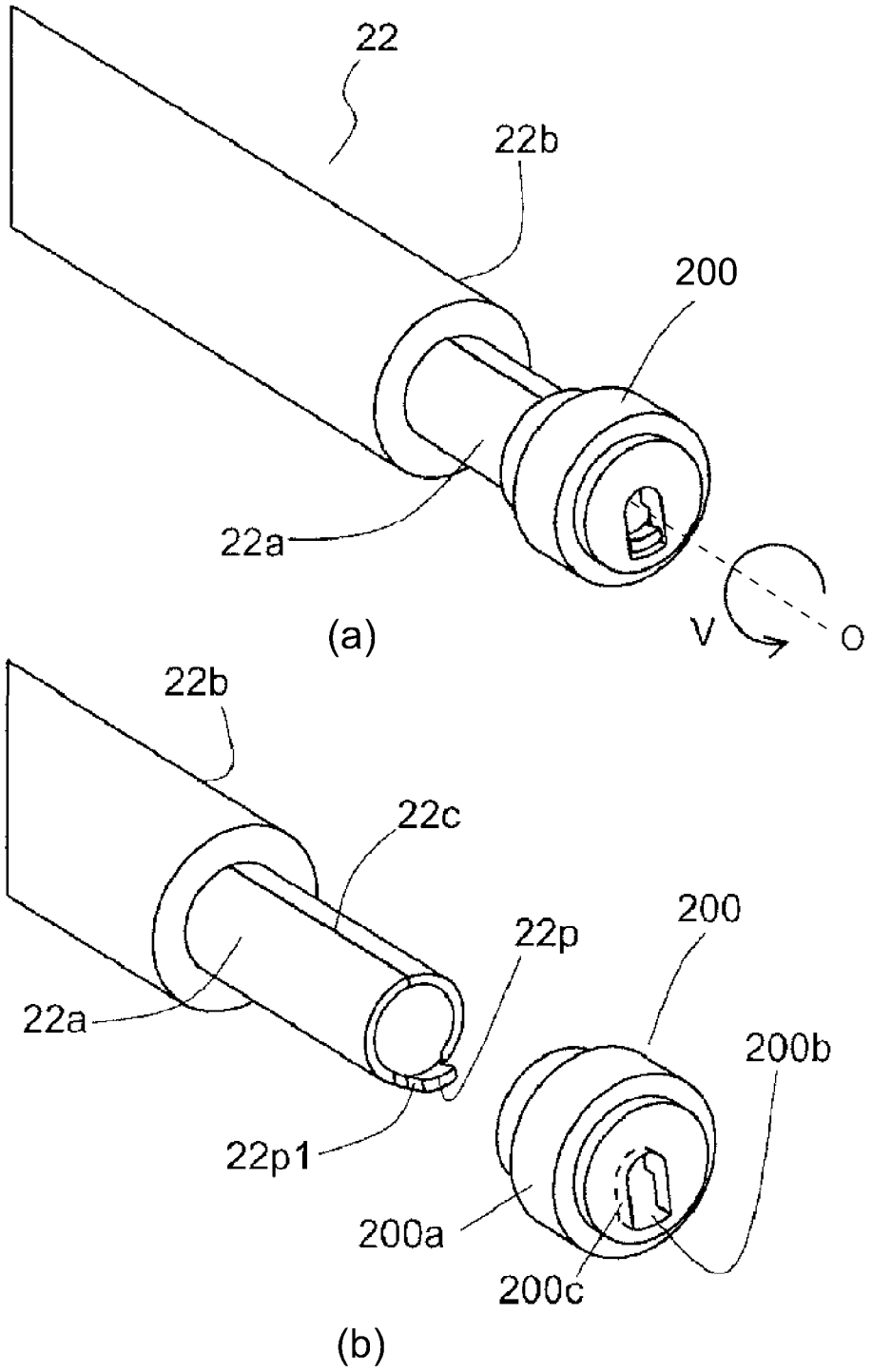

Parts (a) and (b) of FIG. 19 are perspective views showing a structure of a supplying roller according to Embodiment 2.

Figure 20:
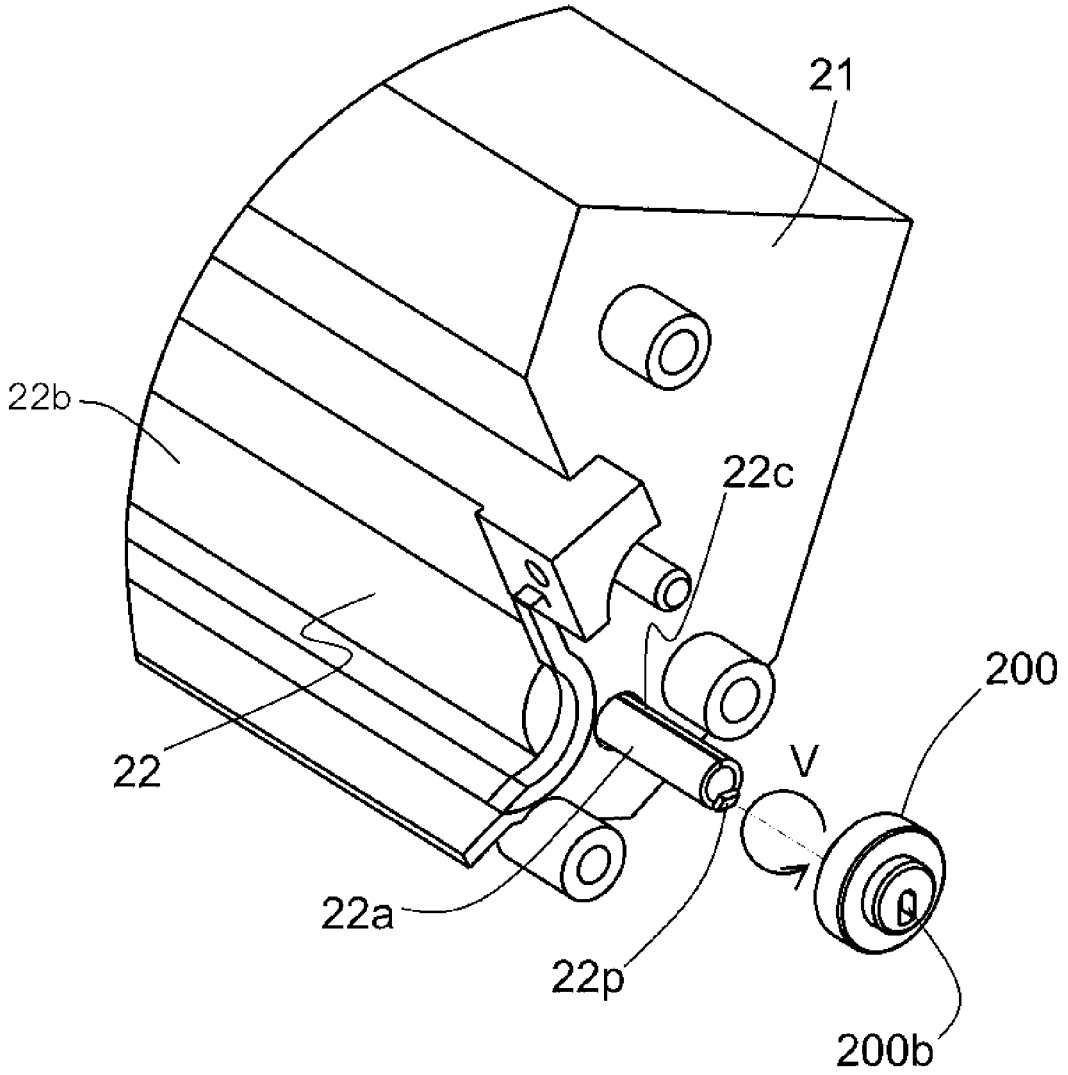

FIG. 20 is a perspective view showing the structure of the supplying roller.

Figure 21:
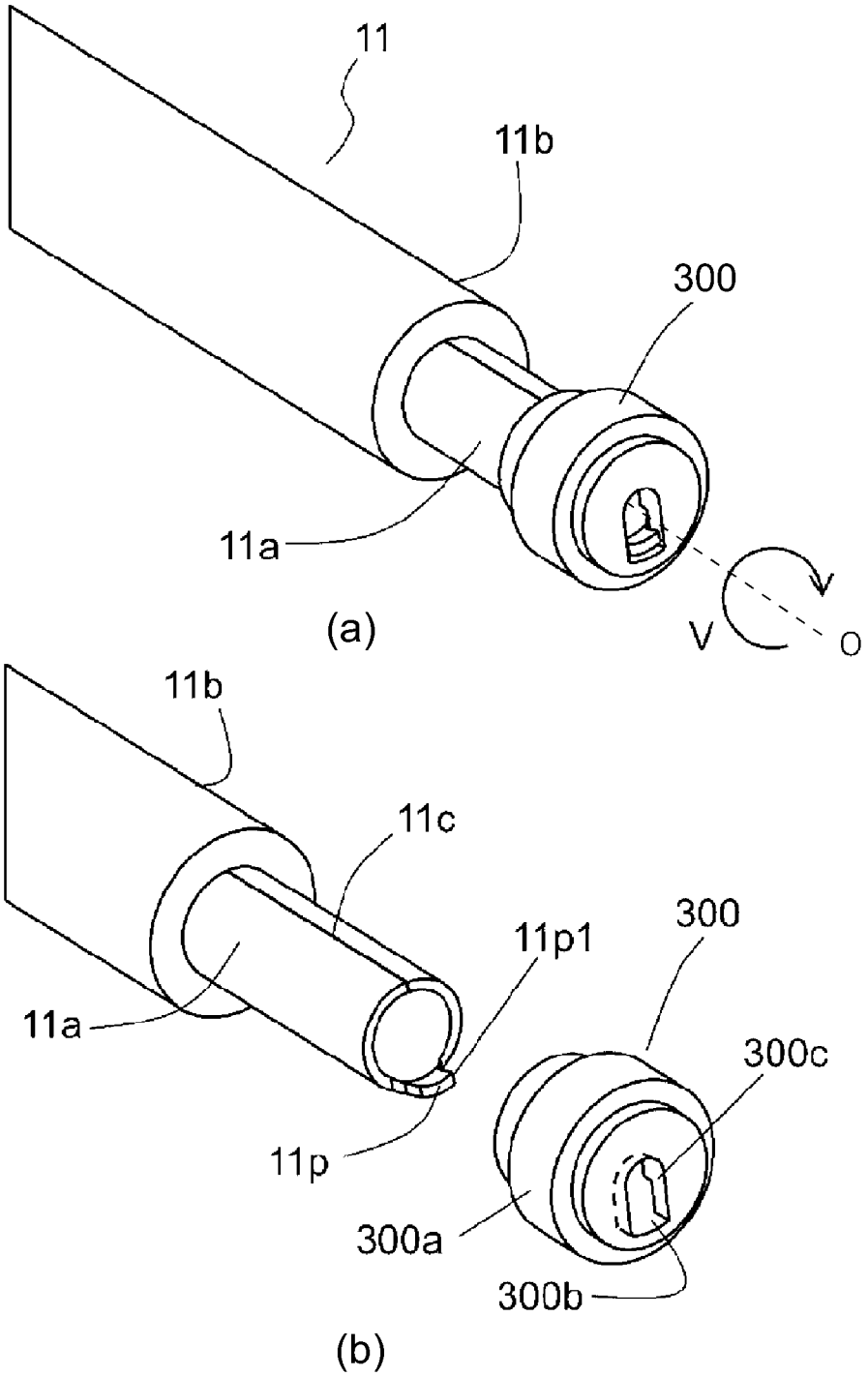

Parts (a) and (b) of FIG. 21 are perspective views showing a structure of a charging roller according to Embodiment 3.

Figure 22:
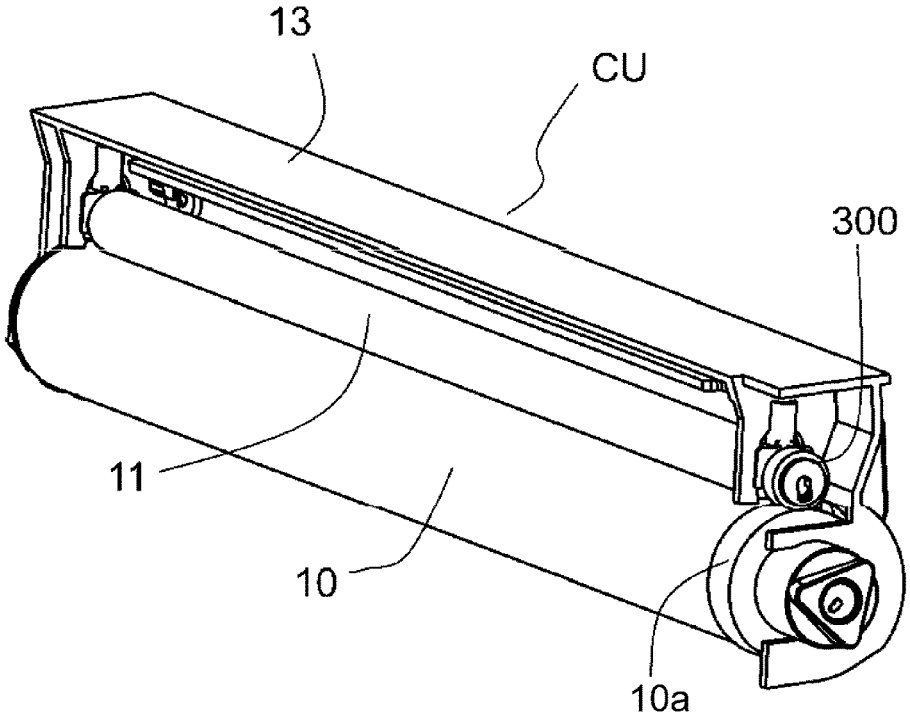

FIG. 22 is a perspective view of a photosensitive member unit.

Figure 23:
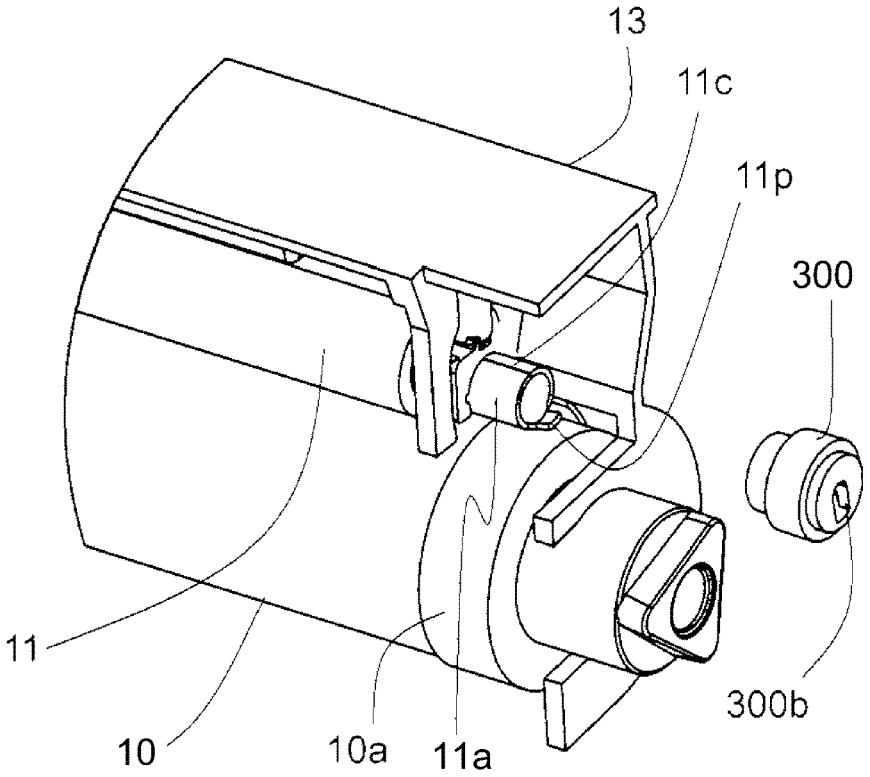

FIG. 23 is a perspective view showing a structure of a driving portion of the charging roller.

DESCRIPTION OF EMBODIMENTS

Embodiments of the present invention will be specifically described with reference to the drawings. Dimensions, materials, shapes and relative arrangements of constituent elements described in the following embodiments should be appropriately be changed depending on structures and various conditions of mechanisms (apparatuses) to which the present invention is applied. That is, the scope of the present invention is not intended to be limited to the following embodiments.

Embodiment 1

Image Forming Apparatus

Figure 2:
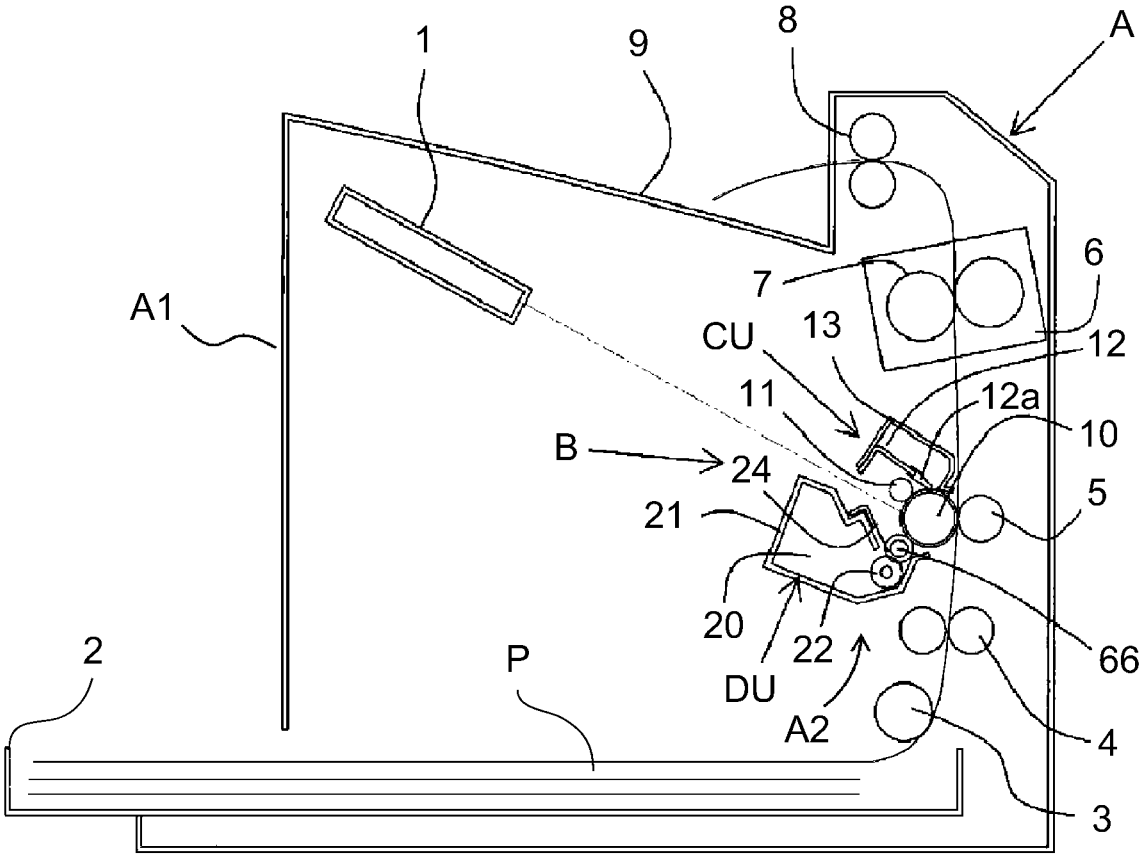
FIG. 2 is a schematic sectional view of an example of an image forming apparatus.

FIG. 2 is a schematic sectional view showing a general structure of an image forming apparatus A according to Embodiment 1 of the present invention. This image forming apparatus A is an electrophotographic laser beam printer in which a toner image (developer image) corresponding to image information inputted from an external host device (not shown) such as a personal computer or an image reader is formed on a recording medium (recording material such as a sheet) P and is printed out. A general structure of this image forming apparatus A will be briefly described along feeding of the recording material P.

The image forming apparatus A includes a photosensitive drum 10 as an image bearing member to be rotationally driven. A surface of this drum 10 is electrically charged by a charging roller 11, and the charged surface of the drum 10 is exposed to light cartridge a latent image data by a scanner portion 1. As a result, a latent image (electrostatic latent image) is formed on the drum surface. The latent image is developed with toner (developer) by a developing unit (developing device) DU, so that a toner image is formed by the drum surface.

In the image forming apparatus A, a feeding cassette 2 capable of accommodating many sheets of the recording material P is provided, and the recording material P is fed one by one by a feeding portion 3. The fed recording material P is fed to a registration roller pair 4. Onto the recording material P fed by the registration roller pair 4, the toner image is transferred from the drum 10. Then, the recording material P is fed to a fixing device 6, and the toner image is fixed on the recording material P by a fixing roller 7. The recording material P on which the image is fixed is discharged to a discharge portion 9 by a discharging roller pair 8.

Process Cartridge

A process cartridge B according to this embodiment is prepared by integrally assembling a photosensitive (member) unit CU and the developing unit (developing device) DU into a cartridge (unit). The process cartridge B is detachably (demountably) mounted to a predetermined mounting portion A2 in an apparatus main assembly A1 of the image forming apparatus A in a predetermined operation procedure.

The photosensitive unit CU includes the photosensitive drum 10, the charging roller 11 as a charging means, a cleaning blade as a cleaning means, and the like. The developing unit DU includes a developing roller (developer carrying roller: developer carrying member) 66 as a developing means, a supplying roller (developer supplying roller) 22, a developing blade 24, a toner accommodating portion 20, a developing container (developing (means) frame) 21, and the like.

In this embodiment, the developing means carries out development in the following manner. First, the toner in the toner accommodating portion 20 is supplied to the developing roller 66 by rotation of the supplying roller 22, and a regulated a toner layer is formed on a surface of the developing roller 66 by the developing blade 24. Then, the toner is transferred onto the drum 10 depending on the latent image, so that the toner image is formed and thus the latent image is visualized as a visible image.

In this embodiment, the cleaning means removes the toner, with the cleaning blade 12, remaining on the drum 10 after the toner image is transferred onto the recording material P by a transfer roller 5. The cleaning blade 12 scrapes the residual toner off the drum 10 by an elastic blade portion 12*a* provided counterdirectionally to the drum 10 so that an edge portion thereof contacts the drum 10, and collects the residual toner in a cleaning (means) frame 13.

Developing Unit

Figure 3:
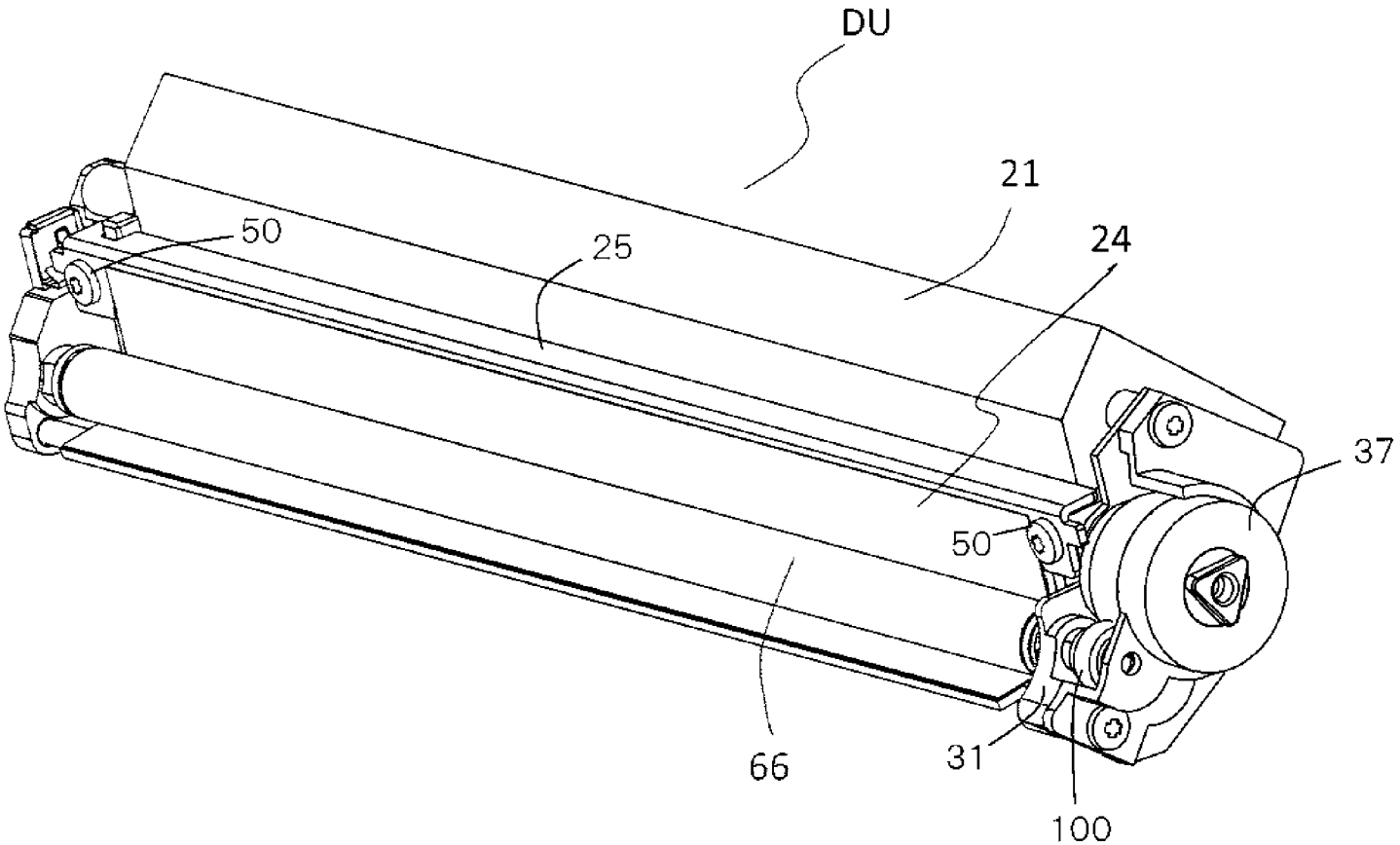
FIG. 3 is a perspective view of a developing device (developing unit).
Figure 4:
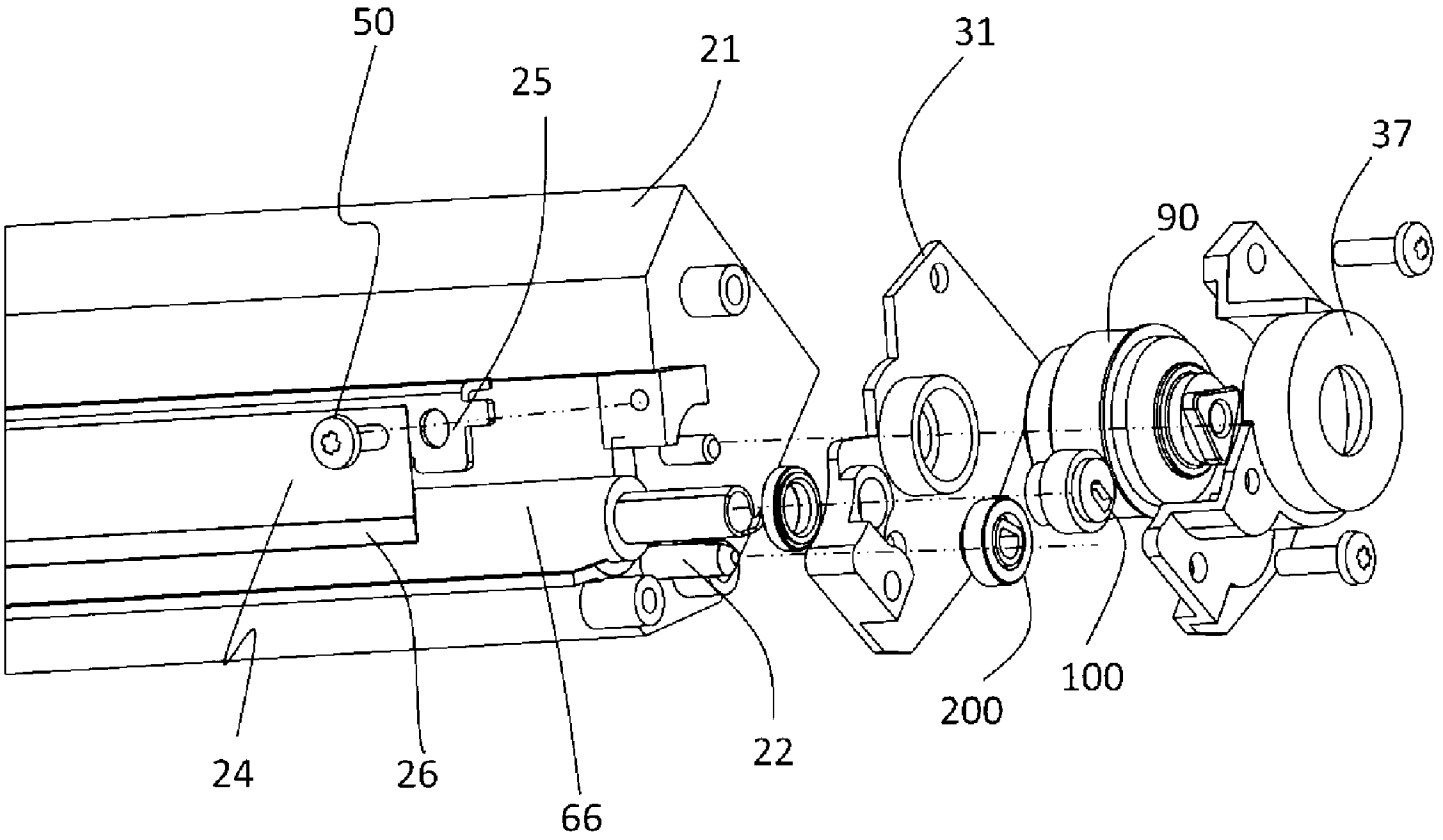
FIG. 4 is an exploded view for illustrating assembling of the developing device.

The developing unit DU according to this embodiment will be described with reference to FIGS. 2 to 4. The developing unit DU is constituted by the toner (developer), the toner accommodating portion 20 accommodating the toner, and the developing container 21 accommodating the developing means such as the toner supplying roller 22, the developing roller 66 and the developing blade 24 as described above. The developing blade 24 is constituted by a contact portion 26 contacting the developing roller 66 and a supporting metal plate 25 supporting the contact portion 26. As a material of the contact portion 26, an elastic material such as a rubber or thin metal is used. In this embodiment and a conventional example, as the contact portion 26, a 0.08 mm-thick stainless steel plate is used.

The developing blade 24 constituted by these component parts is fixed to the developing container 21 with screws 50, and the developing roller 66 and the supplying roller 22 are supported by bearing members 31. Further, the developing unit DU includes driving gears 100 and 200 for driving the developing roller 66 and the supplying roller 22, respectively, and includes a drive input gear 90 for transmitting drive (driving force) from the apparatus main assembly A1 side and for driving the two driving gears 100 and 200, and the drive input gear 90 is covered with a side cover 37.

Incidentally, the developing unit DU may be constituted as a part of the above-described process cartridge B, and may also be independently constituted alone and is detachably mountable to the apparatus main assembly A1.

Developing Roller

Figure 5:
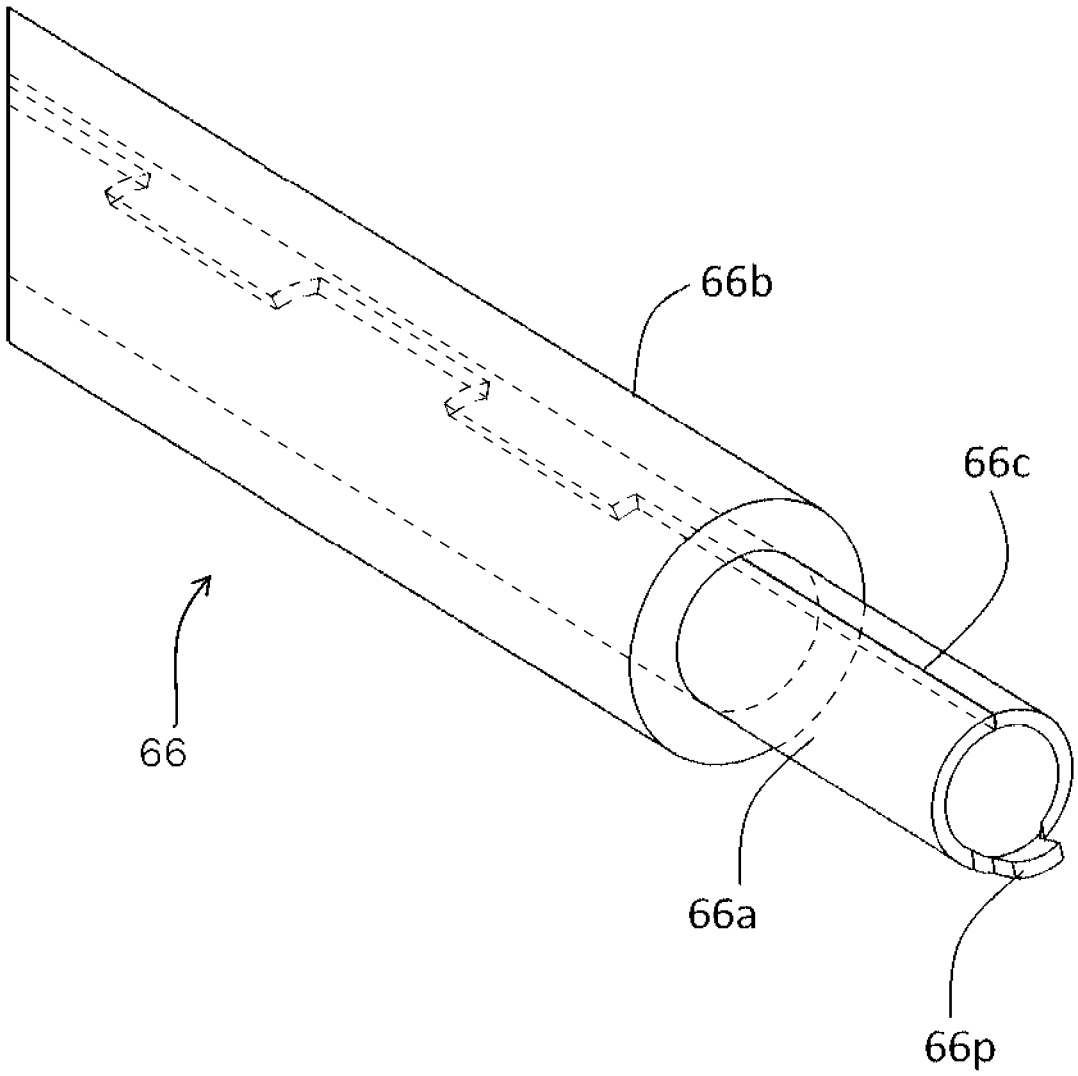
FIG. 5 is a perspective view of a developing roller.

The developing roller 66 in this embodiment is constituted by coating a hollow shaft portion (cylindrical rotation shaft) 66*a* with an electroconductive elastic layer 66*b* in a longitudinal entire region other than longitudinal end portions as shown in FIG. 5. That is, the developing roller 66 is an electroconductive rotatable member. The elastic layer 66*b* and the shaft portion 66*a* are bonded to each other with an adhesive. The shaft portion 66*a* is prepared by molding an electroconductive metal plate, in a cylindrical shape through press work, such as a metal plate obtained by subjecting a surface of a stainless steel or SUM 22 to plating with Ni. Here, the reason why the hollow shaft portion 66*a* molded by the press work is used is that the process cartridge B and the apparatus main assembly A1 are reduced in weight and cost. Next, details of the shaft portion 66*a* will be described.

Developing Roller Shaft Portion

Figure 6:
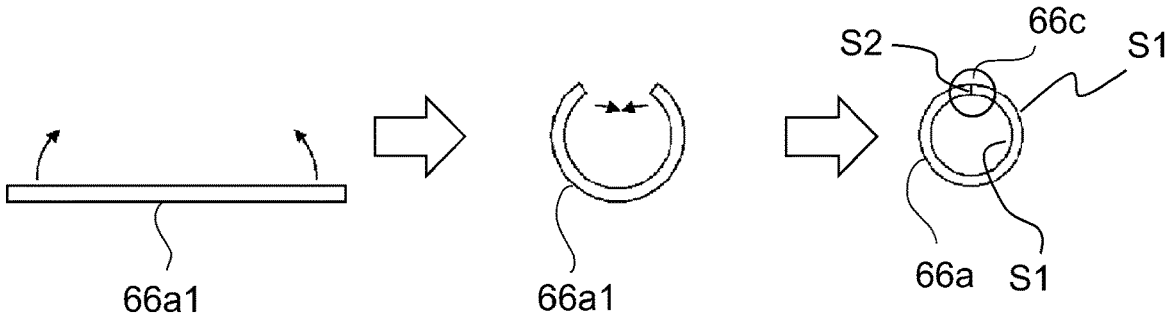
FIG. 6 is an illustration showing manufacturing steps of a shaft portion of the developing roller.

The shaft portion 66*a* of the developing roller 66 is molded by bending (curving) a metal flat plate 66*a*1 in a cylindrical shape as shown in FIG. 6, and therefore, is provided with a metal plate seam (connecting portion) 66*c* formed along an axial direction C (FIG. 7) of the shaft portion 66*a*. That is, an outer peripheral surface of the shaft portion 66*a* is discontinuous with respect to a circumferential direction of the shaft portion 66*a* from one end to the other end of the shaft portion 66*a* with respect to the axial direction C of the shaft portion 66*a*. Here, in this embodiment, an outer diameter of the shaft portion 66*a* is 6 mm, and a full length of the shaft portion 66*a* with respect to the axial direction C is about 270 mm.

As described above, in general, the cylindrical metal shaft is inferior in torsional strength to a cylindrical solid metal shaft having the same diameter. Therefore, in this embodiment, in order to ensure the strength of the shaft portion 66*a* of the developing roller 66, the seam 66*c* is provided with a plurality of uneven portion (projected portions and recessed portions) 66*c*1 as shown in FIG. 7. Details of the seam 66*c* and the uneven portions 66*c*1 will be described later.

Then, a manufacturing method of the shaft portion 66*a* will be described by taking a successive feeding press work which is a general-purpose press work as an example. As shown in FIG. 8, in manufacturing of the shaft portion 66*a*, an about 0.6 mm-thick metal plate such as a cool-rolled steel plate, a zinc-plated steel plate or a stainless steel plate is used. Further, a width of this metal plate is broader than the full length of the shaft portion 66*a* (FIG. 7) with respect to the axial direction C. The metal plate is subjected to the press work (blanking), so that strip flat plates 66*a*1 (portions to be molded in a cylindrical shape) extending in a direction crossing a (sheet) feeding direction H, crosspieces 66*a*4 continuous in the feeding direction D, and connecting portions 66*a*3 connecting the strip flat plates 66*a*1 and the crosspieces 66*a*4 are formed.

Incidentally, each of the crosspieces 66*a*4 is provided with positioning holes 66*a*2, for positioning the flat plates 66*a*1 when the flat plates 66*a*1 are successively fed, on center lines of the strip flat plates 66*a*1. By using the cross pieces 66*a*4, while intermittently feeding the metal plate, the metal plate is repeatedly subjected to a blanking step shown in FIG. 8 and then to a bending (curving) step shown in FIG. 6 thereby to carry out the press work, so that the portions to be molded in the cylindrical shape (i.e., the flat plates 66*a*1) are successively molded in the cylindrical shape step by step (FIG. 9).

After the molding of the flat plate 66*a*1 is completed, the connecting portions 66*a*3 are cut, whereby the cylindrically molded portion (i.e., the strip flat plate 66*a*1) is separated (disconnected) from the crosspieces 66*a*4. A rotational drive transmitting portion (projection, projected portion) 66*p* (FIG. 5) formed in the cutting step will be described later.

Here, a shape of the seam 66*c* of the metal plate in this embodiment will be described. As shown in FIG. 8, the stripe flat plate 66*a*1 has a substantially rectangular shape. Short sides 66*a*5 of the shaft portion 66*a* of the developing roller 66 are parallel to the feeding direction H, and long sides 66*y*1 and 66*y*2 for forming the seam 63*c* are perpendicular to the feeding direction H (i.e., are parallel to the axial direction C).

Further, each of the long sides 66*y*1 and 66*y*2 is provided with an uneven-shaped portion so that projected portions and recessed portions are alternately disposed along the axial direction C, and the corresponding segments two uneven-shaped portions are projected or recessed in different directions with respect to the feeding direction H as shown in FIG. 8. In this embodiment, each of the uneven-shape portions is continuously formed from one end to the other end of the shaft portion 66*a* with respect to the axial direction C. In this embodiment, each of the projected portions and the recessed portions has a rectangular shape. Further, as described above, by subjecting the flat plate to bending in the cylindrical shape, the long sides 66*y*1 and 66*y*2 are bonded (connected) to each other, so that the seam 66*c* having an uneven shape is formed. As shown in FIGS. 5 and 6, the shaft portion 66*a* is constituted by the metal plate 66*a*1 curved in a hollow cylindrical shape, the seam 66*c* refers to a portion where end surfaces of the long sides 66*y*1 and 66*y*2 of the plate-like metal member 66*a*1 are contacted to each other. Incidentally, a surface of the curved plate-like metal member 66*a*1 is constituted by cylindrical surfaces (an outer peripheral surface and an inner peripheral surface) S1 which are surfaces with a broad area and an end surface S2 different from the cylindrical surfaces S1.

The above-described shaft portion 66*a* is summarized as follows. The shaft portion 66*a* is a cylindrical portion including the seam 66*c*, and an outer peripheral surface thereof is discontinuous with respect to a circumferential direction thereof from one end to the other end thereof with respect to the axial direction C thereof. On one side and the other side of the discontinuous portion, the uneven-shaped portions (projected portions and recessed portions) are formed. The projected portions on one side are engaged with the recessed portions on the other side, and the recessed portions on one side are engaged with the projected portions on the other side, so that the seam (connecting portion) 66*c* where the end surfaces of the long sides on one side and the other side are connected with (i.e., contacted to) each other is formed.

The seam 66*c* is constituted by the plurality of the uneven-shaped portions, whereby desired strength is imparted to the shaft portion 66*a*. Although a larger number of uneven-shaped portions is preferable since the strength of the shaft portion is improved, in production, depending on a function of a product, necessary strength may only be required to be appropriately set.

In this embodiment, the seam 66*c* includes a plurality of uneven portions 66*c*1 and two rectilinear portions 66*c*3 as shown in parts (a) and (b) of FIG. 7. The two rectilinear portions 66*c*3 are provided at end portions, respectively, with respect to the axial direction C, and the uneven portions 66*c*1 are provided between the two rectilinear portions 66*c*3.

As shown in part (b) of FIG. 7, in this embodiment, with respect to a direction D perpendicular to the axial direction C of the shaft portion 66*a*, a relationship between a projection amount (=recess amount) E of the uneven portion 66*c*1 and a projection amount F of the rectilinear portion 66c3 of the seam 66c is E>F. In this embodiment, the projection amount E of the shaft portion is 2 mm, and the projection amount F of the shaft portion is 1 mm which is ½ of the projection amount E, but the projection amount E may be selected as a desired value in a range of 1-3 mm.

Rotational Drive Transmitting Portion

Next, the rotational drive transmitting portion 66p formed for driving the developing roller 66 will be described. The rotational drive transmitting portion 66p is provided at an axial end portion of the shaft portion (rotation shaft) 66a and is a portion to which a driving force for rotating the developing roller (rotatable member) 66 is to be transmitted.

Parts (a) and (b) of FIG. 10 are schematic views of the flat plate 66a1 subjected to the above-described bending step, as seen in the feeding direction, and shows a periphery of one end portion of the flat plate 66a1 with respect to a direction perpendicular to the feeding direction, particularly shows a periphery of the connecting portion 66a3 in an enlarged manner. A structure of the flat plate 66a1 on the other side is similar to that on the above one side, and will be omitted from description. In this step, not only the shaft portion 66a is cut from the crosspieces 66a4 but also the rotational drive transmitting portion 66p is formed at the axial end portion of the shaft portion 66a and thus is molded in a final product form.

Part (a) of FIG. 10 shows a state immediately before the connecting portion 66a3 is cut. In this cutting step, metal molds 141, 142 and 143 are provided. The shaft portion 6a is supported by the metal mold 143 on a lower side thereof and is supported by the metal mold 142 on a lower side of the connecting portion 66a3.

Part (b) of FIG. 10 shows a state when the connecting portion 66a3 is cut. To the shaft portion 66a supported by the metal molds 142 and 143, the metal mold 141 having a blade at a free end thereof is lowered, whereby the connecting portion 66a3 is cut. The metal mold 141 is lowered and approaches the metal mold 142, whereby the connecting portion 66a3 is cut, so that an edge portion 66g connecting with the crosspiece 66a4 and the rotational drive transmitting portion 66p which is a projection (projected portion) are formed. Thereafter, the metal mold 141 is further lowered, so that the rotational drive transmitting portion 66p is bent toward an axial center direction of the cylindrical shaft.

That is, when the metal molds 141 and 142 which are a pair of tools are moved relative to each other and the connecting portion 66a3 is cut, a part of the connecting portion 66a3 is left as the rotational drive transmitting portion 66p to the shaft portion 66a, and also after the connecting portion 66a3 is cut, the metal plate 141 is further moved. As a result, the rotational drive transmitting portion 66p is bent with a predetermined angle with respect to the shaft portion 66a. The thus-formed rotational drive transmitting portion 66p which is the projected portion projected from the axial end surface of the shaft portion 66a is a portion for rotating the developing roller 66 which is a rotatable member.

Driving Constitution of Developing Roller

Figure 1:
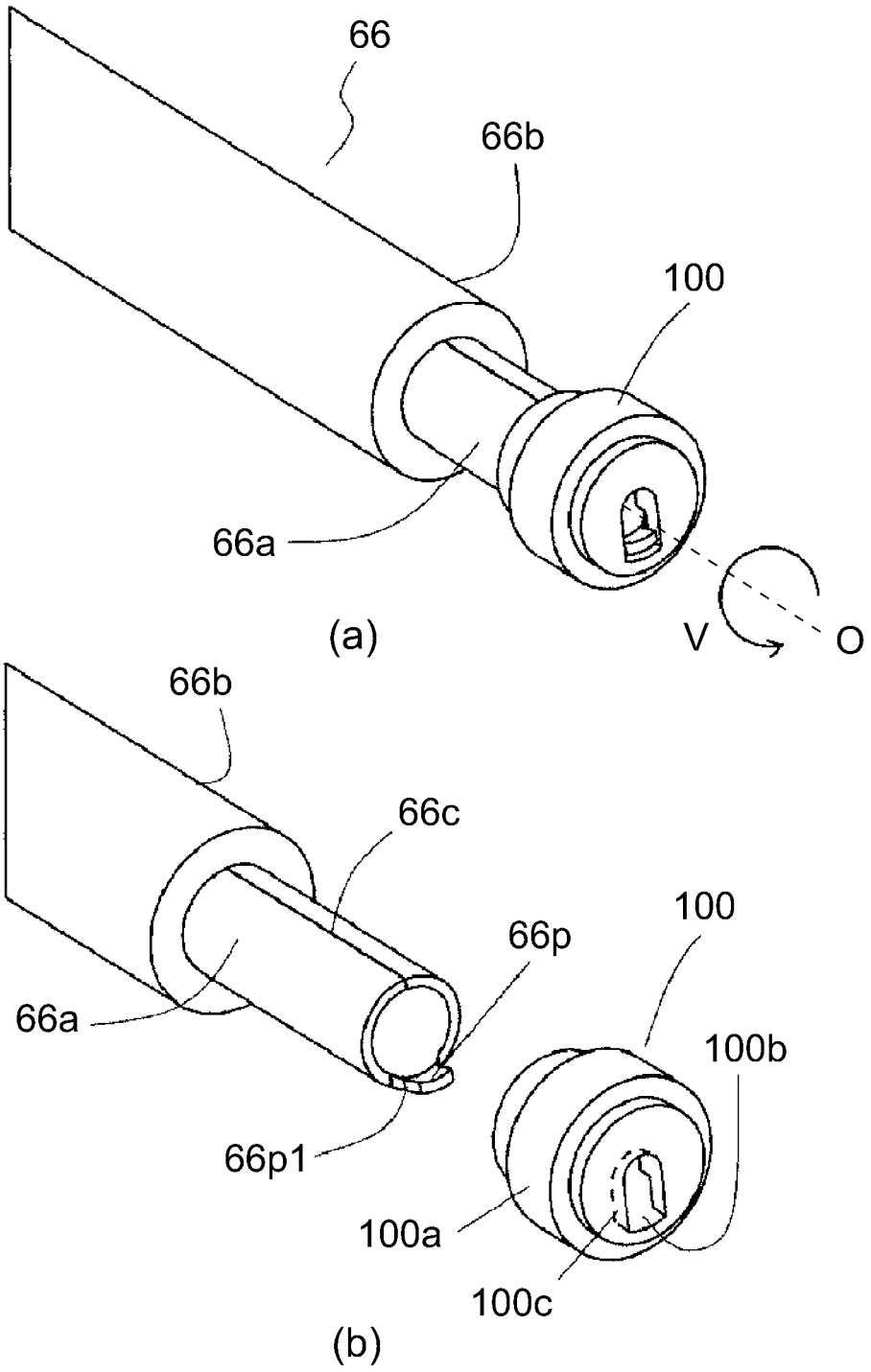

As shown in FIGS. 1 and 11, a driving gear (driver) 100 for driving the developing roller 66 is engaged. Part (a) of FIG. 1 shows a state in which the developing roller 66 and the driving gear 100 are engaged with each other, and part (b) of FIG. 1 is an assembling illustration immediately before the driving gear 100 is engaged with the developing roller 66. FIG. 11 is a schematic view showing a cross section of the developing roller 66 and the driving gear 100 with a developing roller axis as a center line O-O.

The driving gear 100 includes a gear portion 100a, an engaging portion 100b, a side surface 100c of the engaging portion 100b, and a cylindrical hole 100d. The cylindrical hole 100d aligns axial centers of the driving gear 100 and the shaft portion 66a with each other. The rotational drive transmitting portion 66p is engaged with the engaging portion 100b provided in the driving gear 100, so that fixing of the driving gear 100 to the shaft portion 66a with respect to a rotational direction of the driving gear 100 is made.

In the case of this embodiment, the driving gear 100 rotates in an arrow V direction, whereby the side surface 100c of the engaging hole of the driving gear 100 is contacted to at least a side surface 66p1 of the rotational drive transmitting portion 66p and thus a rotational force is transmitted to the shaft portion 66a, so that the developing roller 66 is rotated. As shown in part (b) of FIG. 1, the side surface 66p1 is an end surface of the plate-like metal member (metal plate) 66a1.

Phase of Developing Portion

When a rotational driving force is transmitted to the rotational drive transmitting portion 66p, the side surface 66p1 of the rotational drive transmitting portion 66p receives the driving force from the side surface 100c of the driving gear 100. Here, depending on a phase of the rotational drive transmitting portion 66p with the seam 66c, a position of the rotational drive transmitting portion 66p has an influence of deformation of the shaft portion 66a in the neighborhood of the seam 66c due to the driving force. This is because the seam 66c is not subjected to welding and bonding, and therefore, depending on a direction of the force received by the side surface 66p1, deformation such that the shaft portion 66a temporarily opens along the circumferential direction or shafts in a radial direction at the seam 66c thereof.

FIG. 12 is a schematic view of the developing roller 66 as viewed in an axial direction and shows a coordinate system when the rotational direction V of the shaft portion 66a from the seam 66c as a base point (=0°) about an axial center O of the shaft portion 66a is a positive direction. The rotational drive transmitting portion 66p is simplified in shape and is hatched for convenience of explanation. A position of the seam 66c in FIG. 12 represents the position of the seam 66c at the axial end portion of the shaft portion 66a, i.e., the position of the rectilinear portion 66c3 as is understood from part (b) of FIG. 1 and FIG. 5. The same is true for subsequent description. In FIG. 12, a state in which the rotational drive transmitting portion 66p is in a phase of 180° from the seam 66c.

Here, for example, in the case where the rotational drive transmitting portion 66p is provided so that the side surface 66p1 thereof is positioned in the phase of 0° (FIGS. 14 and 15), the seam 66c and the side surface 66p1 coincide with each other. Then, a direction of a force acting on a left side (upstream side of the rotational direction) of the seam 66c is an arrow S direction as shown in FIG. 15. That is, the force acts in a direction in which the seam 66c opens. Further, for example, as shown in FIG. 16, also in the case where the phase of the side surface 66p1 of the rotational drive transmitting portion 66p is about 40°, by the force acting on the side surface 66p1 of the rotational drive transmitting portion 66*p*, a component (arrow Sx) of the force exerted in the direction of opening the left side of the seam 66*c* exists.

Further, the force exerted on the side surface 66*p*1 of the rotational drive transmitting portion 66*p* during the rotational drive is always not constant, and in actuality, a driving torque from the driving gear 100 minutely fluctuates due to various factors such as a frictional fluctuation, and therefore, also the force acting on the side surface 66*p*1 of the rotational drive transmitting portion 66*p* fluctuates. That is, also the force acting on the seam 66*c* fluctuates, and therefore, also an amount of the deformation of the seam 66*c* fluctuates. Accordingly, at a portion of the seam 66*c*, the deformation such that the shaft portion 66*a* minutely opens or the opened portion returns to an original position is repeated, and therefore, a fluctuation in rotational speed of the shaft portion 66*a* generates. The rotational speed fluctuation of the shaft portion 66*a* causes a rotational speed fluctuation (non-uniformity) of the developing roller 66 and constitutes a factor of image disturbance.

Therefore, it is desirable that the phase of the rotational drive transmitting portion 66*p* is set at a position excluding the phase where the force is exerted in the direction of opening the seam 66*c*. In this embodiment, as described above, the rotational drive transmitting portion 66*p* is formed using the connecting portion 66*a*3 necessary in the manufacturing step, and therefore, the rotational drive transmitting portion 66*p* was provided at a phase (180°) opposite from the seam 66*c* in the coordinate system 66*p* (FIG. 12). Incidentally, a width of the rotational drive transmitting portion 66*p* in this embodiment is 2 mm, so that the contact surface (side surface) 66*p*1 is in a phase shifted from 180° by about ½ of the width.

The force acting on the seam 66*c* at this time is shown in FIG. 13. In the case of this phase, a reaction force Sx of an acting force S is exerted on a right side (downstream side of the rotational direction) of the seam 66*c*, and therefore, the force does not act in the direction of opening the seam 66*c*. As a result, when the minute torque fluctuation generates, the fluctuation in rotational speed of the developing roller 66 is suppressed and thus the image disturbance (non-uniformity) can be suppressed.

Incidentally, a desirable phase is not limited thereto, but for example, as shown in part (a) of FIG. 17, in the case where the phase of the side surface 66*p*1 of the rotational drive transmitting portion 66*p* is 90°, there is no component of the force for opening the seam 66*c* as shown in part (b) of FIG. 17. Further, as shown in FIG. 18, in the case where the side surface 66*p*1 of the rotational drive transmitting portion 66*p* is provided in a phase close to the seam 66*c* on a right side of the seam 66*c*, an acting force Sx acts on the right side of the seam 66*c*, and therefore, there is no force for opening the seam 66*c*.

The above-described constitution is summarized as follows. The rotational drive transmitting portion 66*p* which is the projected portion of the shaft portion 66*a* includes the contact surface 66*p*1 which contacts the driving gear 100 as the driver for driving the developing roller 66 as the rotatable member and which receives the driving force from the driving gear 100. Further, the coordinate system when the rotational direction V in which the developing roller 66 rotates about the center axis O-O of the shaft portion 66*a* in order to form the image is the positive rotational direction and the seam 66*c* as the connecting portion is the base point will be considered. In this coordinate system, the contact surface 66*p*1 is provided in the phase away by 90° or more from the seam 66*c* at the axial end portion of the shaft portion 66*a*. This is a feature of the constitution of this embodiment.

Thus, when the phase of the side surface 66*p*1 of the rotational drive transmitting portion is provided in a range (range of an angle θ shown in FIGS. 17 and 18) of 90° or more in the above-described coordinate system, the force does not act in the direction of opening the seam 66*c*. For that reason, when the minute torque fluctuation generates, the fluctuation in rotational speed of the developing roller is suppressed, so that the image disturbance (non-uniformity) can be suppressed.

Embodiment 2

In Embodiment 1, an example in which the present invention is applied to the developing roller was described, but the present invention is also applicable to the case where a hollow core metal is used in the supplying roller (developer supplying roller) 22 which is similarly a rotatable member. Parts (a) and (b) of FIG. 19 are perspective views for illustrating the supplying roller 22 and a driving gear (driver) 200 in this embodiment, and FIG. 20 is a perspective view for illustrating a structure of a developing frame 21, the supplying roller 22 and the driving gear 200.

The supplying roller 22 in this embodiment is constituted, similarly as in the case of the developing roller 66 described in Embodiment 1, by coating a hollow shaft portion 22*a* with an elastic layer 22*b* in an entire longitudinal region other than longitudinal end portions. Shapes of the shaft portion 22*a* and the driving gear 200 are similar to those of the shaft portion 66*a* and the driving gear 100 in Embodiment 1 and will be omitted from detailed description.

A driving constitution of the supplying roller 22 will be described. A rotational drive transmitting portion 22*p* of the shaft portion 22*a* of the supplying roller 22 is engaged in an engaging hole 200*b* of the driving gear 200 of the supplying roller 22, so that rotational drive (rotational driving force) is transmitted to the supplying roller 22. Here, at least a side surface 22*p*1 of the rotational drive transmitting portion 22*p* and a side surface 200*c* of the engaging hole 200*b* of the driving gear 200 contact each other.

As regards a position where the rotational drive transmitting portion 22*p* is provided, similarly as in Embodiment 1, the side surface 22*p*1 of the rotational drive transmitting portion 22*p* is provided at a position of 90° or more with respect to the rotational direction from a seam 22*c* at an axial end portion of the shaft portion 22*a* in a coordinate system of the supplying roller 22. As a result, a rotational speed fluctuation of the supplying roller 22 is suppressed, so that an effect of reducing a degree of non-uniformity of supply of the developer to the supplying roller 22 can be obtained.

Embodiment 3

Next, an example in which the present invention is applied to the charging roller is shown. Parts (a) and (b) of FIG. 21 are perspective views for illustrating the charging roller 11 and a driving gear (driver) 300 in this embodiment. FIGS. 22 and 23 are perspective views showing a photosensitive (member) unit CU. The photosensitive unit CU is constituted by the drum 10, the charging roller 11, the driving gear 300 for driving the charging roller 11, a drum gear 10*a* for transmitting drive (driving force) to the driving gear 300, an unshown cleaning blade (12 in FIG. 2), and the cleaning (means) frame 13 for supporting these members. For convenience of explanation, the cleaning frame 13 is partly omitted in FIG. 23.

The charging roller 11 in this embodiment is an electroconductive roller constituted, similarly as in the case of the developing roller 66 described in Embodiment 1, by coating a hollow shaft portion 11*a* with an electroconductive elastic layer 11*b* in an entire longitudinal region other than longitudinal end portions. Shapes of the shaft portion 11*a* and the driving gear 300 are similar to those of the shaft portion 66*a* and the driving gear 100 in Embodiment 1 and will be omitted from detailed description.

A driving constitution of the charging roller 11 will be described. A rotational drive transmitting portion 11*p* of the shaft portion 11*a* of the charging roller 11 is engaged in an engaging hole 300*b* of the driving gear 300 of the charging roller 11, so that rotational drive (rotational driving force) is transmitted to the charging roller 11. Here, at least a side surface 11*p*1 of the rotational drive transmitting portion 11*p* and a side surface 300*c* of the engaging hole 300*b* of the driving gear 300 contact each other.

As regards a position where the rotational drive transmitting portion 11*p* is provided, similarly as in Embodiment 1, the side surface 11*p*1 of the rotational drive transmitting portion 11*p* is provided at a position of 90° or more with respect to the rotational direction from a seam 11*c* at an axial end portion of the shaft portion 11*a* in a coordinate system of the charging roller 11. As a result, a rotational speed fluctuation of the charging roller 11 is suppressed, so that an effect of reducing a degree of charging non-uniformity which can generate on the surface of the photosensitive drum.

Here, the electrophotographic image forming apparatus also includes an image forming apparatus of a transfer type or a direct type, in which a latent image, such as an electrostatic latent image, a magnetic latent image or a resistance pattern latent image, is formed using an electrostatic recording dielectric member or a magnetic recording (magnetic) material as the image bearing member and is developed with the developer. Also in this case, such an image forming apparatus is referred to as the electrophotographic image forming apparatus.

Incidentally, in the above-described embodiments, the rotational drive transmitting portion 66*p* (22*p*, 11*p*) was the projection (projected portion) projected from the axial end surface of the shaft portion 66*a* (22*a*, 11*a*) but is not limited thereto. The rotational drive transmitting portion 66*p* may also be constituted by a recessed portion such that the rotational drive transmitting portion 66*p* is cut away so that the axial end surface of the shaft portion 66*a* is recessed in the axial direction. In this case, the side surface of this recessed portion may only be required to be constituted so as to receive the driving force in contact with the side surface of the driving gear 100.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2017-081257 filed on Apr. 17, 2017 and 2018-029515 filed on Feb. 22, 2018, which are hereby incorporated by reference herein in their entirety.

What is claimed is:

1. A rotatable member usable for forming an image on a recording material, comprising:

a hollow cylindrical rotation shaft formed with a curved plate like member and including an outer peripheral surface and an inner peripheral surface which are cylindrical surfaces, said hollow cylindrical rotation shaft having a rotational axis, wherein said rotation shaft includes a seam where end surfaces of the plate like member are contacted to each other from one end to the other end of said rotation shaft with respect to an axial direction of said rotation shaft, wherein said rotation shaft includes a rotational drive transmitting portion which is provided at an axial end portion thereof and to which a driving force for rotating said rotation shaft is transmitted, wherein said rotational drive transmitting portion is a projection portion projected from an axial end surface of said rotation shaft and bent toward an axial center direction of said rotational shaft, said projection portion is projecting from the axial end surface toward an outside of said rotation shaft along the axial direction of said rotation shaft, wherein said projection portion includes, at an end surface different from the outer peripheral surface and the inner peripheral surface, a contact surface contactable to a driver for driving said rotation shaft and configured to receive the driving force from said driver, and wherein in a coordinate system with the rotational axis as an origin, said contact surface is provided at a position away by 90° or more from the seam in a normal rotational direction which is a direction in which said rotatable member rotates to form the image.

2. A rotatable member according to claim 1, wherein at a portion where said seam is formed, projected portions and recessed portions are formed, and wherein the projected portion on one side is engaged with the recessed portion on the other side and the projected portion on said the other side is engaged with said one side and thus the end surfaces of the curved plate like member on said one side and said the other side are contacted to each other.

3. A rotatable member according to claim 1, wherein the curved plate like member is made of metal.

4. A rotatable member according to claim 1, wherein said rotatable member is a roller having electroconductivity.

5. A rotatable member according to claim 1, wherein said rotatable member is a developer carrying roller configured to carry a developer for forming the image on the recording material.

6. A rotatable member according to claim 1, wherein said rotatable member is a developer supplying roller configured to supply a developer to a developer carrying member for forming the image on the recording material.

7. A rotatable member according to claim 1, wherein said rotatable member is a charging roller configured to electrically charge an image bearing member for forming the image on the recording material.

8. A cartridge detachably mountable to a main assembly of an image forming apparatus in which a developer image is formed by developing, with a developer, a latent image formed on a photosensitive member and then is transferred onto a recording material, said cartridge comprising:

a rotatable member usable for forming an image on a recording material, wherein said rotatable member comprises a hollow cylindrical rotation shaft formed with a curved plate like member and including an outer peripheral surface and an inner peripheral surface which are cylindrical surfaces, said hollow cylindrical rotation shaft having a rotational axis, wherein said rotation shaft includes a seam where end surfaces of the plate like member are contacted to each other from one end to the other end of said rotation shaft with respect to an axial direction of said rotation shaft, wherein said rotation shaft includes a rotational drive transmitting portion which is provided at an axial end portion thereof and to which a driving force for rotating said rotation shaft is transmitted, wherein said rotational drive transmitting portion is a projection portion projected from an axial end surface of said rotation shaft and is bent toward an axial center direction of said rotational shaft, said projection portion being projected from the axial end surface toward an outside of said rotation shaft along the axial direction of said rotation shaft, wherein said projection portion includes, at an end surface different from the outer peripheral surface and the inner peripheral surface, a contact surface contactable to a driver for driving said rotation shaft and configured to receive the driving force from said driver, and wherein in a coordinate system with the rotational axis as an origin, said contact surface is provided at a position away by 90° or more from the seam in a normal rotational direction which is a direction in which said rotatable member rotates to form the image.

9. A cartridge member according to claim 8, wherein at a portion where said seam is formed, projected portions and recessed portions are formed, and wherein the projected portion on one side is engaged with the recessed portion on the other side and the projected portion on said the other side is engaged with said one side and thus the end surfaces of the curved plate like member on said one side and said the other side are contacted to each other.

10. A cartridge member according to claim 8, wherein the curved plate like member is made of metal.

11. A cartridge member according to claim 8, wherein said rotatable member is a roller having electroconductivity.

12. A cartridge member according to claim 8, wherein said rotatable member is a developer carrying roller configured to carry a developer for forming the image on the recording material.

13. A cartridge member according to claim 8, wherein said rotatable member is a developer supplying roller configured to supply a developer to a developer carrying member for forming the image on the recording material.

14. A cartridge member according to claim 8, wherein said rotatable member is a charging roller configured to electrically charge an image bearing member for forming the image on the recording material.

15. A cartridge according to claim 8, further comprising said photosensitive member.

16. An image forming apparatus in which a developer image is formed by developing, with a developer, a latent image formed on a photosensitive member and then is transferred onto a recording material, said image forming apparatus comprising:

a rotatable member usable for forming an image on a recording material, comprising:

wherein said rotatable member comprises a hollow cylindrical rotation shaft formed with a curved plate like member and including an outer peripheral surface and an inner peripheral surface which are cylindrical surfaces, said hollow cylindrical rotation shaft having a rotational axis, wherein said rotation shaft includes a seam where end surfaces of the plate like member are contacted to each other from one end to the other end of said rotation shaft with respect to an axial direction of said rotation shaft, wherein said rotation shaft includes a rotational drive transmitting portion which is provided at an axial end portion thereof and to which a driving force for rotating said rotation shaft is transmitted, wherein said rotational drive transmitting portion is a projection portion projected from an axial end surface of said rotation shaft and bent toward an axial center direction of said rotational shaft, said projection portion being projected from the axial end surface toward an outside of said rotation shaft along the axial direction of said rotation shaft, wherein said projection portion includes, at an end surface different from the outer peripheral surface and the inner peripheral surface, a contact surface contactable to a driver for driving said rotation shaft and configured to receive the driving force from said driver, and wherein in a coordinate system with the rotational axis as an origin, said contact surface is provided at a position away by 90° or more from the seam in a normal rotational direction which is a direction in which said rotatable member rotates to form the image.

17. An image forming apparatus according to claim 16, wherein at a portion where said seam is formed, projected portions and recessed portions are formed, and wherein the projected portion on one side is engaged with the recessed portion on the other side and the projected portion on said the other side is engaged with said one side and thus the end surfaces of the curved plate like member on said one side and said the other side are contacted to each other.

18. An image forming apparatus according to claim 16, wherein the curved plate like member is made of metal.

19. An image forming apparatus according to claim 16, wherein said rotatable member is a roller having electroconductivity.

* * * * *